US008264913B2

(12) United States Patent
Abe

(10) Patent No.: US 8,264,913 B2
(45) Date of Patent: Sep. 11, 2012

(54) TIME INFORMATION OBTAINING APPARATUS AND RADIO WAVE TIMEPIECE

(75) Inventor: Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 422 days.

(21) Appl. No.: 12/685,124

(22) Filed: Jan. 11, 2010

(65) Prior Publication Data

US 2010/0177602 A1 Jul. 15, 2010

(30) Foreign Application Priority Data

Jan. 15, 2009 (JP) ..... 2009-006730

(51) Int. Cl.
*G04C 11/02* (2006.01)

(52) U.S. Cl. ..... 368/47

(58) Field of Classification Search ..... 368/47
See application file for complete search history.

(56) References Cited

U.S. PATENT DOCUMENTS

| | | | | |
|---|---|---|---|---|
| 6,346,911 | B1 | 2/2002 | King | |
| 7,428,190 | B2 * | 9/2008 | Sano | 368/47 |
| 7,555,029 | B2 | 6/2009 | Kondo | |
| 7,738,322 | B2 * | 6/2010 | Murata et al. | 368/47 |
| 2005/0195690 | A1 | 9/2005 | Kondo | |
| 2007/0140064 | A1 * | 6/2007 | Fujisawa | 368/47 |
| 2007/0152900 | A1 | 7/2007 | Takada | |
| 2008/0239880 | A1 * | 10/2008 | Murata et al. | 368/47 |
| 2008/0240076 | A1 | 10/2008 | Someya | |
| 2009/0016171 | A1 * | 1/2009 | Fujisawa | 368/47 |

FOREIGN PATENT DOCUMENTS

| | | | |
|---|---|---|---|
| EP | 1 662 344 | A2 | 5/2006 |
| JP | 2005-249632 | A | 9/2005 |
| JP | 2006-153626 | A | 6/2006 |
| JP | 2007-147328 | A | 6/2007 |
| JP | 2008-241351 | A | 10/2008 |
| WO | WO 01/75470 | A1 | 10/2001 |
| WO | WO2005/062137 | A1 | 7/2005 |

OTHER PUBLICATIONS

Extended European Search Report dated Oct. 6, 2010 (in English) in counterpart European Application No. 10150471.0.
Japanese Office Action dated Jan. 18, 2011 (and English translation thereof) in counterpart Japanese Application No. 2009-006730.

* cited by examiner

*Primary Examiner* — Sean Kayes
(74) *Attorney, Agent, or Firm* — Holtz, Holtz, Goodman & Chick, PC

(57) ABSTRACT

A time information obtaining apparatus, comprises: an input waveform data generating section for sampling a received signal including a time code at a predetermined sampling period to obtain sampling points every one unit time length, and generating input waveform data having one or more unit time lengths based on data having at least one unit time length including the obtained sampling points; a predicted waveform data generating section for generating a plurality of pieces of predicted waveform data with respect to each class of a standard time radio wave; a correlation value calculating section for calculating correlation values between the input waveform data and the plurality of pieces of predicted waveform data of each of the classes; a correlation value comparing section for comparing the correlation values to calculate optimum values; and a judging section for judging the class of the standard time wave based on the optimum values.

16 Claims, 16 Drawing Sheets

TIME INFORMATION OBTAINING APPARATUS AND RADIO WAVE TIMEPIECE

CROSS-REFERENCE TO RELATED APPLICATIONS

This application is based on and claims the benefit of priority from the prior Japanese Patent Application No. 2009-006730, filed on Jan. 15, 2009 including specification, claims, drawings and summary, the entire contents of which are incorporated herein by reference.

BACKGROUND OF THE INVENTION

1. Field of the Invention

The present invention relates to a time information obtaining apparatus receiving a standard time radio wave to obtain the time information thereof, and further relates to a radio wave timepiece mounted with the time information obtaining apparatus.

2. Related Art

Now, long wave standard time radio waves are transmitted from transmitting stations in each of Japan, Germany, the United Kingdom, Switzerland, and the like. For example, in Japan, standard time radio waves of 40 kHz and 60 kHz subjected to amplitude modulations are transmitted from transmitting stations in Fukushima Prefecture and Saga Prefecture, respectively. Each of the standard time radio waves includes a row of codes constituting a time code indicating a year, a month, a day, a time, and a minute, and is adapted to be transmitted in the period of 60 seconds. That is, the period of the time code is 60 seconds.

Timepieces (radio wave timepieces) capable of receiving a standard time radio wave including such a time code, of extracting the time code from the received standard time radio wave, and of correcting the displayed time thereof have been put to practical use. A receiving circuit of a radio wave timepiece includes a band-pass filter (BPF) for accepting a standard time radio wave received with an antenna to extract only a standard time radio wave signal, a demodulator circuit demodulating the standard time radio wave signal subjected to an amplitude modulation by envelope detection or the like, and a processing circuit reading the time code included in the signal demodulated by the demodulator circuit.

A conventional processing circuit performs in order a process of second synchronization processing, minute synchronization processing, code capturing, and consistency judgment after the detection of a standard time radio wave. If any pieces of the processing have not be appropriately ended, then the processing circuit has to recommence the process from the beginning. Consequently, the processing circuit may have to recommence the process many times owing to the influences by the noise included in a signal, and then a period of time until the time information can be obtained may become remarkably long.

SUMMARY OF THE INVENTION

According to an aspect of the present invention, there is provided a time information obtaining apparatus comprises:

a receiving section for receiving a standard time radio wave;

an input waveform data generating section for sampling a signal including a time code output from the receiving section at a predetermined sampling period to obtain sampling points every one unit time length corresponding to one code constituting the time code, each of the sampling points being a value expressed by a plurality of bits, and generating input waveform data having one or more unit time lengths based on data having at least one of the obtained unit time lengths each including the obtained sampling points;

a predicted waveform data generating section for generating a plurality of pieces of predicted waveform data, each sampling point of which being a value expressed by a plurality of bits, the predicted waveform data having a same time length as that of the input waveform data, the predicted waveform data having one or more unit time lengths representing each of classes of standard time radio waves with respect to each class of the standard time radio wave;

a correlation value calculating section for calculating correlation values between the input waveform data and the plurality of pieces of predicted waveform data of each of the classes;

a correlation value comparing section for comparing the correlation values calculated by the correlation value calculating section to one another to calculate an optimum value of the correlation values of each of the classes; and a judging section for judging the class of the standard time wave based on the optimum value of each of the classes.

DETAILED DESCRIPTION OF THE PREFERRED EMBODIMENTS

In the following, the preferred embodiments of the present invention will be described with reference to the accompanying drawings. In an embodiment of the present invention, a time information obtaining apparatus according to the present invention is provided to a radio wave timepiece. The radio wave timepiece receives a long wave band, especially a standard time radio wave of 60 kHz, subjected to amplitude modulation, detects the received signal, judges the class of the signal, extracts a row of the codes indicating the time code included in the signal, and corrects a displayed time on the basis of the row of the codes.

In each of Japan, the United States of America, and the United Kingdom, a standard time radio wave of 60 kHz is transmitted from a transmitting station. In Japan, each of two transmitting stations located in Fukushima Prefecture and Saga Prefecture transmits a standard time radio wave called JJY. The frequency of the standard time radio wave transmitted from the transmitting station in Saga Prefecture is 60 kHz. Moreover, the frequencies of WWVB of the United States of America and MSF of the United Kingdom are also 60 kHz.

A standard time radio wave basically includes a row of codes constituting a time code indicating a year, a month, a day, a time, and a minute, and is transmitted in the period of 60 seconds. Because the length of one code is a unit time length (one second), 60 codes can be included in one period.

Figure 1:
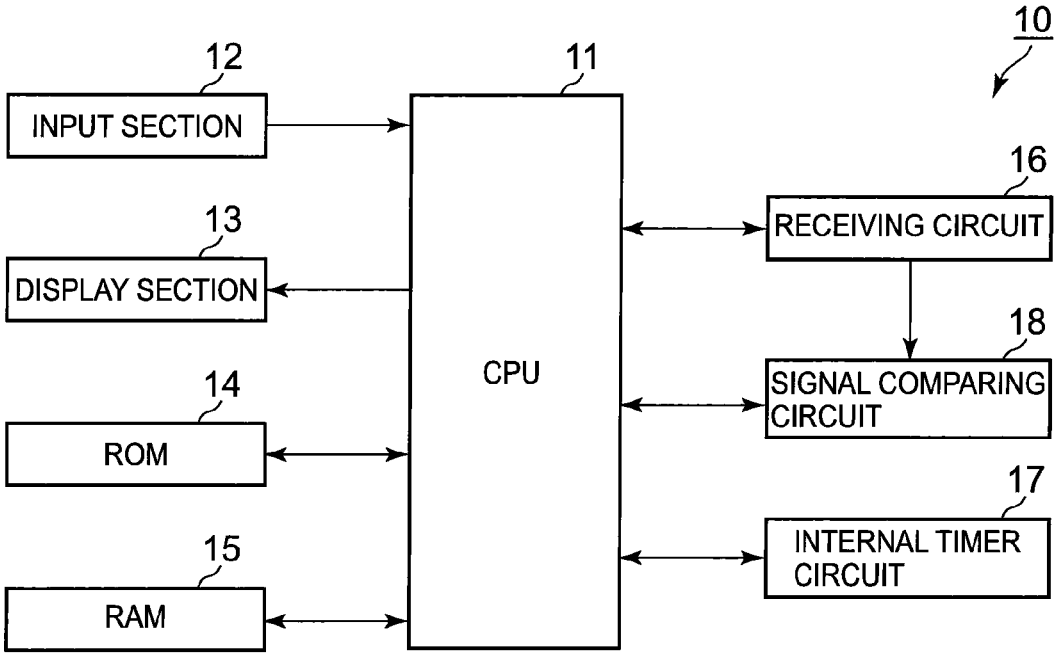
FIG. 1 is a block diagram showing the configuration of a radio wave timepiece according to the present embodiment.

FIG. 1 is a block diagram showing the configuration of a radio wave timepiece according to the present embodiment. As shown in FIG. 1, the radio wave timepiece 10 includes a central processing unit (CPU) 11 (judging section, decoding section, present time calculating section, time correcting section), an input section 12, a display section 13 (time display section), a read only memory (ROM) 14, a random access memory (RAM) 15, a receiving circuit 16 (receiving section), an internal timer circuit 17 (internal timer section), and a signal comparing circuit 18.

The CPU 11 reads a program stored in the ROM 14 at a predetermined timing or in response to an operation signal input from the input section 12 to expand the read program into the RAM 15. Then, the CPU 11 executes an instruction to each section constituting the radio wave timepiece 10, a transfer of data, and the like, on the basis of the expanded program. To put it concretely, the CPU 11, for example, controls the receiving circuit 16 every predetermined period of time to make the receiving circuit 16 receive a standard time radio wave, judges the class of the standard time radio wave from the digital data based on the signal obtained from the receiving circuit 16, specifies the row of the codes included in the standard time radio wave signal in accordance with the signal format of the judged class, and executes the processing of correcting the present time timed by the internal timer circuit 17 on the basis of the row of the codes. Moreover, the CPU 11 executes the processing of transferring the present time timed by the internal timer circuit 17 to the display section 13, and the like.

In the present embodiment, a time information obtaining apparatus generates a plurality of pieces of predicted waveform data representing respective classes of standard time radio waves for one or more unit time lengths, compares the generated pieces of the predicted waveform data and the plurality of pieces of input waveform data received by the receiving circuit 16, and thereby judges the class of the received standard time radio wave. When the class of a standard time radio wave is judged, the pieces of the predicted waveform data representing the respective classes of the standard time radio waves are generated. Moreover, it is also possible to specify a second starting position, a minute starting position, and the like, by similarly comparing the predicted waveform data and the input waveform data.

The input section 12 includes switches for instructing the execution of the various functions of the radio wave timepiece 10, and the input section 12 outputs corresponding operation signals when the switches are operated. The display section 13 includes a dial plate, a plurality of hands controlled by the CPU 11, and a liquid crystal panel, and displays the present time timed by the internal timer circuit 17. The ROM 14 stores a system program for operating the radio wave timepiece 10, application programs for realizing predetermined functions, and the like. The programs for realizing the predetermined functions include the programs and the like for the judging processing of a standard time radio wave, the detecting processing of a second pulse, the detecting processing of a minute starting position, and the obtaining (decoding) processing of the values indicated by various codes, which pieces of processing will be described later. The RAM 15 is used as a working area of the CPU 11, and temporarily stores a program and data, both read from the ROM 14, the data processed by the CPU 11, and the like.

The receiving circuit 16 includes an antenna circuit 50, a detector circuit 53 (see FIG. 2), and the like, and demodulates a signal obtained from a standard time radio wave received with the antenna circuit to output the demodulated signal to the signal comparing circuit 18. The internal timer circuit 17 includes an oscillating circuit, and counts a timepiece signal output from the oscillating circuit to time the present time. The internal time circuit 17 then outputs the data of the timed present time to the CPU 11.

Figure 2:
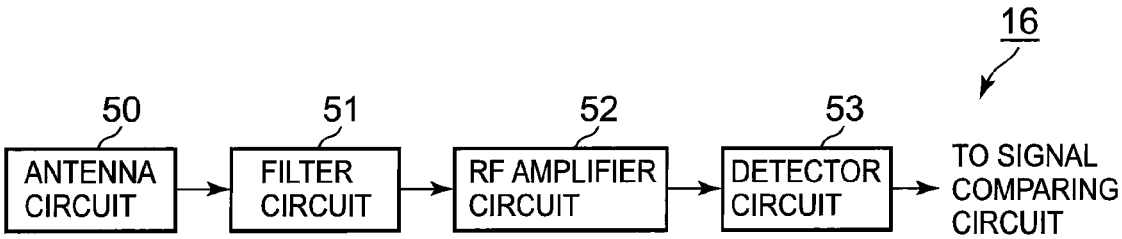
FIG. 2 is a block diagram showing a configuration example of a receiving circuit according to the present embodiment.

FIG. 2 is a block diagram showing a configuration example of the receiving circuit 16 according to the present embodiment. As shown in FIG. 2, the receiving circuit 16 includes the antenna circuit 50 receiving a standard time radio wave, a filter circuit 51 removing the noise of the signal of the standard time radio wave (standard time radio wave signal) received by the antenna circuit 50, a radio frequency (RF) amplifier circuit 52 amplifying the high frequency signal of the output of the filter circuit 51, and the detector circuit 53 detecting a signal output from the RF amplifier circuit 52 to demodulate the standard time radio wave signal. The receiving circuit 16 outputs the signal demodulated by the detector circuit 53 to the signal comparing circuit 18. Incidentally, the present embodiment is adapted to be able to receive the standard time radio wave signal subjected to an amplitude modulation with a modulation wave having a frequency of 60 kHz, and accordingly the constants of the filter circuit 51 and the detector circuit 53 are determined so as to receive a radio wave of the 60 kHz.

Figure 3:
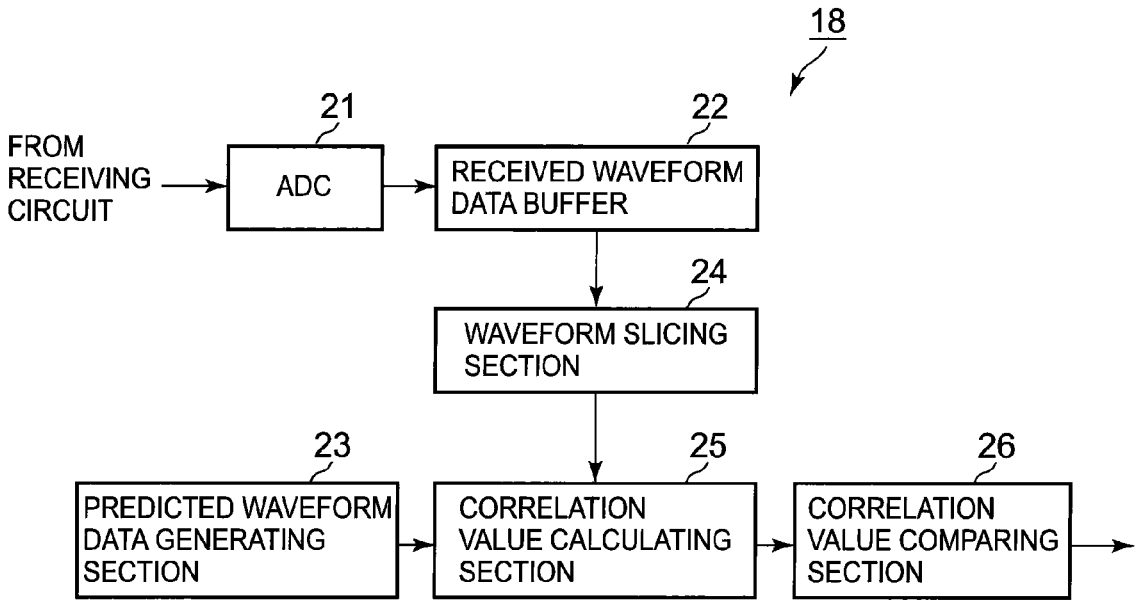
FIG. 3 is a block diagram showing the configuration of a signal comparing circuit according to the present embodiment.

FIG. 3 is a block diagram showing the configuration of the signal comparing circuit 18 according to the present embodiment. As shown in FIG. 3, the signal comparing circuit 18 according to the present embodiment includes an analog-digital (AD) converter (ADC) 21, a received waveform data buffer (input waveform data generating section), a predicted waveform data generating section 23, a waveform slicing section 24 (input waveform data generating section), a correlation value calculating section 25, and a correlation value comparing section 26.

The ADC 21 converts a signal output from the receiving circuit 16 at predetermined sampling intervals into digital data having a value expressed by a plurality of bits (for example, eight bits), and the ADC 21 outputs the converted digital data. For example, each of the sampling intervals is 50 ms, and 20 samples of the digital data can be obtained per second. The received waveform data buffer 22 stores the data in order. The received waveform data buffer 22 can store data of a plurality of unit time lengths (one unit time length: one second) (for example, 10 unit periods of time (10 seconds)), and erases the stored data in the time order of being stored when the received wave form data buffer 22 newly stores data.

The predicted waveform data generating section 23 generates predicted waveform data having a predetermined time length to be a comparison object to be used by each processing described below. The predicted waveform data generated by the predicted waveform data generating section 23 will be described in detail at each processing. The waveform slicing section 24 extracts the input waveform data having the same time length as that of the predicted waveform data from the received waveform data buffer 22.

The correlation value calculating section 25 calculates a correlation value between each of a plurality of pieces of predicted waveform data and each piece of the input waveform data. The present embodiment adopts covariance for obtaining the correlations, as described below. The correlation value comparing section 26 compares the correlation values calculated by the correlation value calculating section 25 to specify the optimum value of them.

Figure 4:
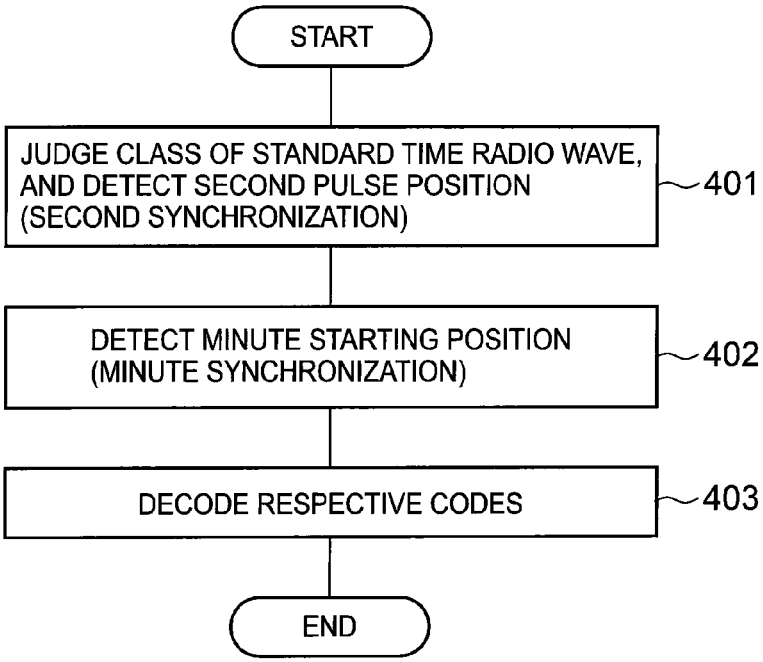
FIG. 4 is a flow chart showing the outline of processing executed in a radio wave timepiece according to the present embodiment.

FIG. 4 is a flow chart showing the outline of the processing executed in the radio wave timepiece 10 according to the present embodiment. The processing shown in FIG. 4 is mainly executed by the CPU 11 and the signal comparing circuit 18 based on the instructions of the CPU 11. As shown in FIG. 4, the CPU 11 and the signal comparing circuit 18 (hereinafter also referred to as "CPU 11 and the like" for reasons of the convenience of description) judges the class of a standard time radio wave, and detects a second pulse position in the judged standard time radio wave (Step 401). As described below, in the present embodiment, it is possible to simultaneously realize the obtainment of the class of a standard time radio wave and the obtainment of the second pulse potion (that is, the starting point of a second) by comparing input waveform data and predicted waveform data, described below.

Before the description of the details of processing, the classes of standard time radio waves and the format of the standard time radio wave signal of JJY in Japan will be described. Generally, a standard time radio wave signal includes 60 ranging codes, composed of a plurality of kinds of the ones, each of which codes has a unit time length of one second, and the codes forma frame having a time length of one minute.

Figures 5A, 5B, 5C:
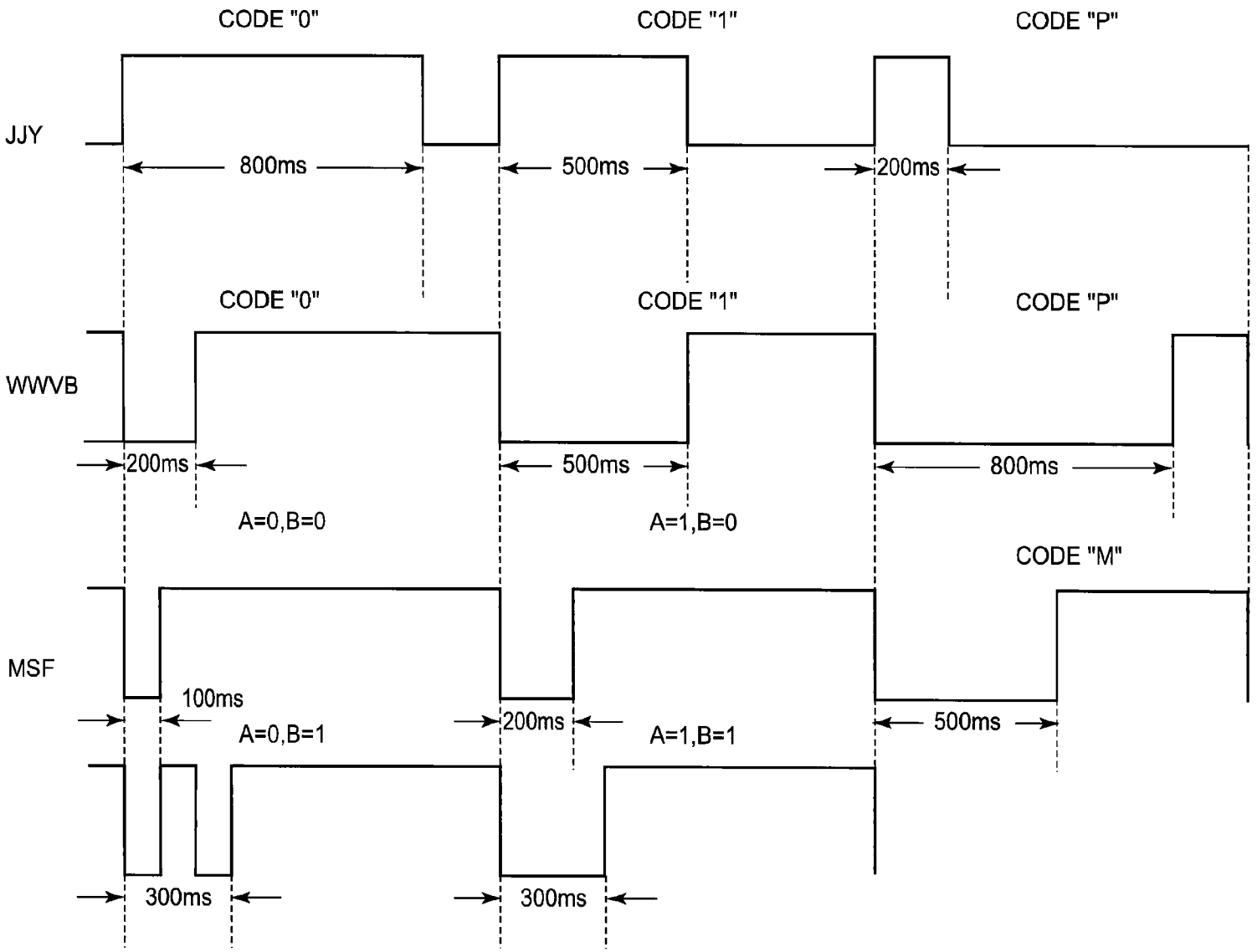
FIGS. 5A-5C are diagrams showing the codes in accordance with the formats of JJY, WWVB, and MSF, respectively.

FIGS. 5A-5C are diagrams showing the codes in accordance with the formats of JJY, WWVB, and MSF, respectively. FIG. 5A is a diagram showing the codes included in JJY of Japan. As shown in FIG. 5A, JJY includes three codes indicating "0," "1," and "P," respectively. Each of the codes of JJY rises from a low level to a high level at the starting position of a second. The code "0" of JJY takes the high level only during the initial 800 ms, and takes the low level during the following 200 ms. The code "1" takes the high level only during the initial 500 ms, and takes the low level during the following 500 ms. Moreover, the code "P" is one used as a position marker or a marker. The code "P" takes the high level only during the initial 200 ms, and takes the low level during the following 800 ms.

FIG. 5B is a diagram showing the codes included in WWVB of the United State of America. As shown in FIG. 5B, WWVB includes three codes indicating "0," "1," and "P," respectively. Each of the codes of WWVB falls from a high level to a low level at the starting position of a second. The code "0" of WWVB takes the low level only during the initial 200 ms, and takes the high level during the following 800 ms. The code "1" takes the low level only during the initial 500 ms, and takes the high level during the following 500 ms. Moreover, the code "P" takes the low level only during the initial 800 ms, and takes the high level during the following 200 ms.

FIG. 5C is a diagram showing the codes included in MSF in the United Kingdom. MSF includes five codes unlike JJY and WWVB, and four codes among them can indicate the respective values of two bits (A, B). Each of the codes of MSF falls from a high level to a low level at the starting position of a second. The code corresponding to "A=0, B=0" takes the low level only during the initial 100 ms, and takes the high level during the following 900 ms. The code corresponding to "A=1, B=0" takes the low level only during the initial 200 ms, and takes the high level during the following 800 ms. Moreover, the code "M" corresponding to a marker takes the low level only during the initial 500 ms, and takes the high level during the following 500 ms. The code corresponding to "A=0, B=1" sequentially takes the low level, the high level, and the low level for each 100 ms during the initial 300 ms, and takes the high level during the following 700 ms. Moreover, the code corresponding to "A=1, B=1" takes the low level only during the initial 300 ms, and takes the high level during the following 700 ms.

Figure 6:
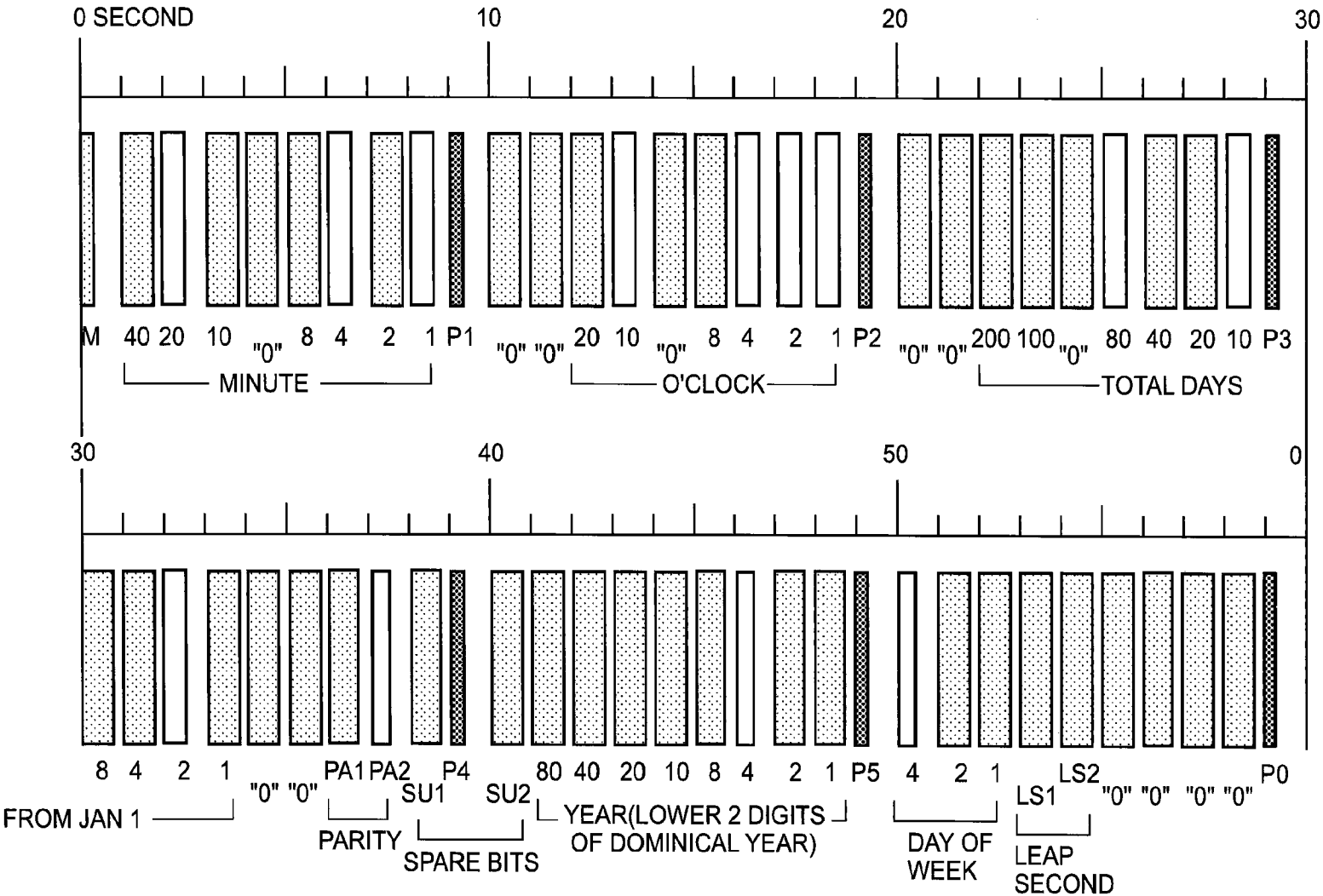
FIG. 6 is a diagram illustrating the format of a standard time radio wave signal by JJY.

FIG. 6 is a diagram illustrating the format of the standard time radio wave signal by JJY. As shown in FIG. 6, the standard time radio wave signal by JJY includes the ranging codes indicating the "P," "1," and "0," mentioned above, each having a unit time length of one second. The standard time radio wave sets 60 seconds as one frame, and one frame includes 60 codes. Moreover, position markers "P1," "P2," . . . , or markers "M" occur every 10 seconds in the standard time radio wave by JJY, and the starting position of a frame occurring every 60 seconds, that is, the starting position of a minute, can be found by detecting a part in which the position marker "P0" arranged at the end of a frame and the marker "M" arranged at the starting position of the next frame continuously occur.

In the present embodiment, the predicted waveform data generating section 23 prepares first predicted waveform data, which is the data having the unit time length and representing JJY, and second predicted waveform data, which is the data having the unit time length and representing a standard time radio wave other than JJY, and generates a plurality of pieces of predicted waveform data, the starting positions of the codes of which are shifted by 50 ms from each other in order, to each of the first predicted waveform data and the second predicted waveform data. In the present embodiment, the correlation value calculating section 25 calculates the correlation values between each of the plurality of pieces of first predicted waveform data and the input waveform data, and calculates the correlation values between each of the plurality of pieces of second predicted waveform data and the input waveform data. Moreover, in the present embodiment, the optimum correlation value pertaining to the first predicted waveform data and the optimum correlation value pertaining to the second predicted waveform data are compared to judge the class of a received standard time radio wave. Moreover, in the present embodiment, a second pulse position (the starting position of a second) from a rise of the predicted waveform data indicating the optimum correlation value from the low level to the high level or a fall thereof from the high level to the low level is detected.

After the judgment of the class of the standard time radio wave and the detection of the second pulse position (Step 401), the CPU 11 and the like detect the starting position of a minute, that is, the starting position of the standard time radio wave signal of the one frame (Step 402). If the class of the standard time radio wave is judged, for example, to be JJY at Step 402, the CPU 11 and the like generate predicted waveform data having two unit time lengths including two continuing codes "P," and calculate the correlation values between the predicted waveform data and a plurality of pieces of input waveform data. Also the processing at Step 402 will be described later in detail.

After that, the CPU 11 and the like decode various codes of the standard time radio wave signal (the code (M1) at the position of units of a minute, the code (M10) at the position of tens of the minute, and the other codes indicating a date, a time, a day of the week, and the like) (Step 403).

Next, the judgment processing of the class of a standard time radio wave and the detection processing of a second pulse position (Step 401) according to the present embodiment will be described more minutely. Incidentally, the detection of a second pulse position is also referred to as second synchronization in the present description.

Figure 7:
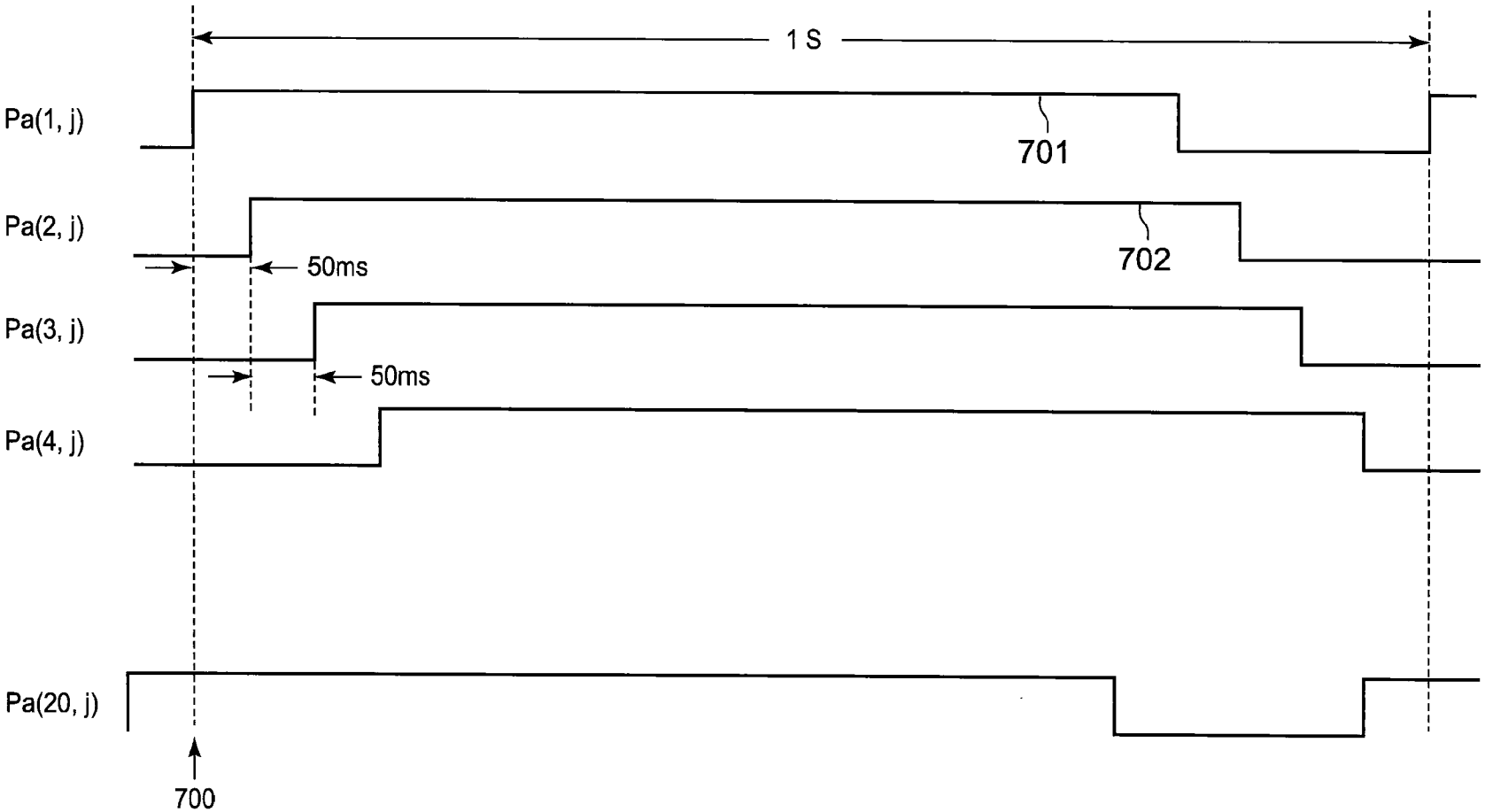
FIG. 7 is a diagram showing an example of a first predicted waveform data to be used in the present embodiment.
Figure 8:
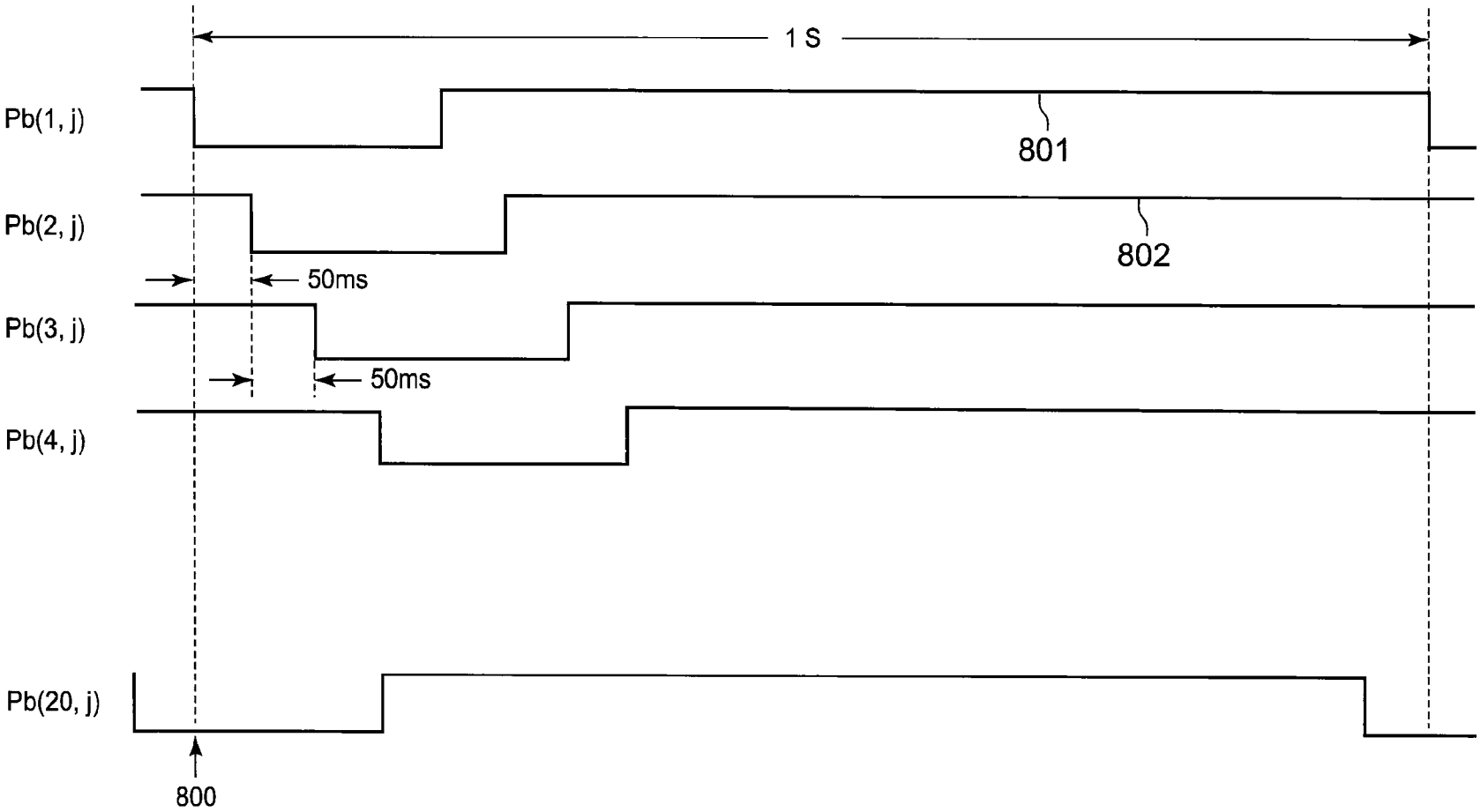
FIG. 8 is a diagram showing an example of a second predicted waveform data to be used in the present embodiment.

FIG. 7 is a diagram showing an example of the first predicted waveform data to be used in the present embodiment, and FIG. 8 is a diagram showing an example of the second predicted waveform data to be used in the present embodiment. As shown in FIG. 7, each of 20 pieces of first predicted waveform data Pa(1, j)-Pa(20, j) has a value of the data of the code "0" having the unit time length based on JJY, the starting position of which code is shifted by 50 ms from each other in order. For example, the starting position of the data (see reference numeral 700) of the initial first predicted waveform data Pa(1, j) (see reference numeral 701) agrees with the starting position of the code thereof. On the other hand, the starting position of the code of the next first predicted waveform data Pa(2, j) (see reference numeral 702) delays from the starting position 700 of the data by 50 ms.

Moreover, in the present embodiment, each piece of the first predicted waveform data Pa(1, j)-Pa(20, j) is the digital data having a value expressed by a plurality of bits (for example, eight bits) similarly to input waveform data, and each of the sampling intervals of the first predicted waveform data Pa(1, j)-Pa(20, j) is set for 50 ms. Consequently, adjacent first predicted waveform data (for example, Pa(1, j) and Pa(2, j)) are shifted from each other by one sample. Moreover, in the present embodiment, the numbers of the bits of each of the first predicted waveform data Pa(1, j)-Pa(20, j) and those of the input waveform data are the same.

As shown in FIG. 8, each of 20 pieces of second predicted waveform data Pb(1, j)-Pb(20, j) has a value of the data of the code "0" based on WWVB, the starting position of which code is shifted by 50 ms from each other in order. For example, the starting position of the data (see reference numeral 800) of the initial second predicted waveform data Pb(1, j) (see reference numeral 801) agrees with the starting position of the code thereof. On the other hand, the starting position of the code of the next second predicted waveform data Pb(2, j) (see reference numeral 802) delays from the starting position 800 of the data by 50 ms.

Similarly to the first predicted waveform data Pa(1, j)-Pa(20, j), each piece of the second predicted waveform data Pb(1, j)-Pb(20, j) is the digital data having a value expressed by a plurality of bits (for example, eight bits), and each of the sampling intervals of the second predicted waveform data Pb(1, j)-Pb(20, j) is set for 50 ms. Moreover, also the number of bits of each of the second predicted waveform data Pb(1, j)-Pb(20, j) is the same as those of each of the first predicted waveform data Pa(1, j)-Pa(20, j) and the input waveform data.

Figure 9:
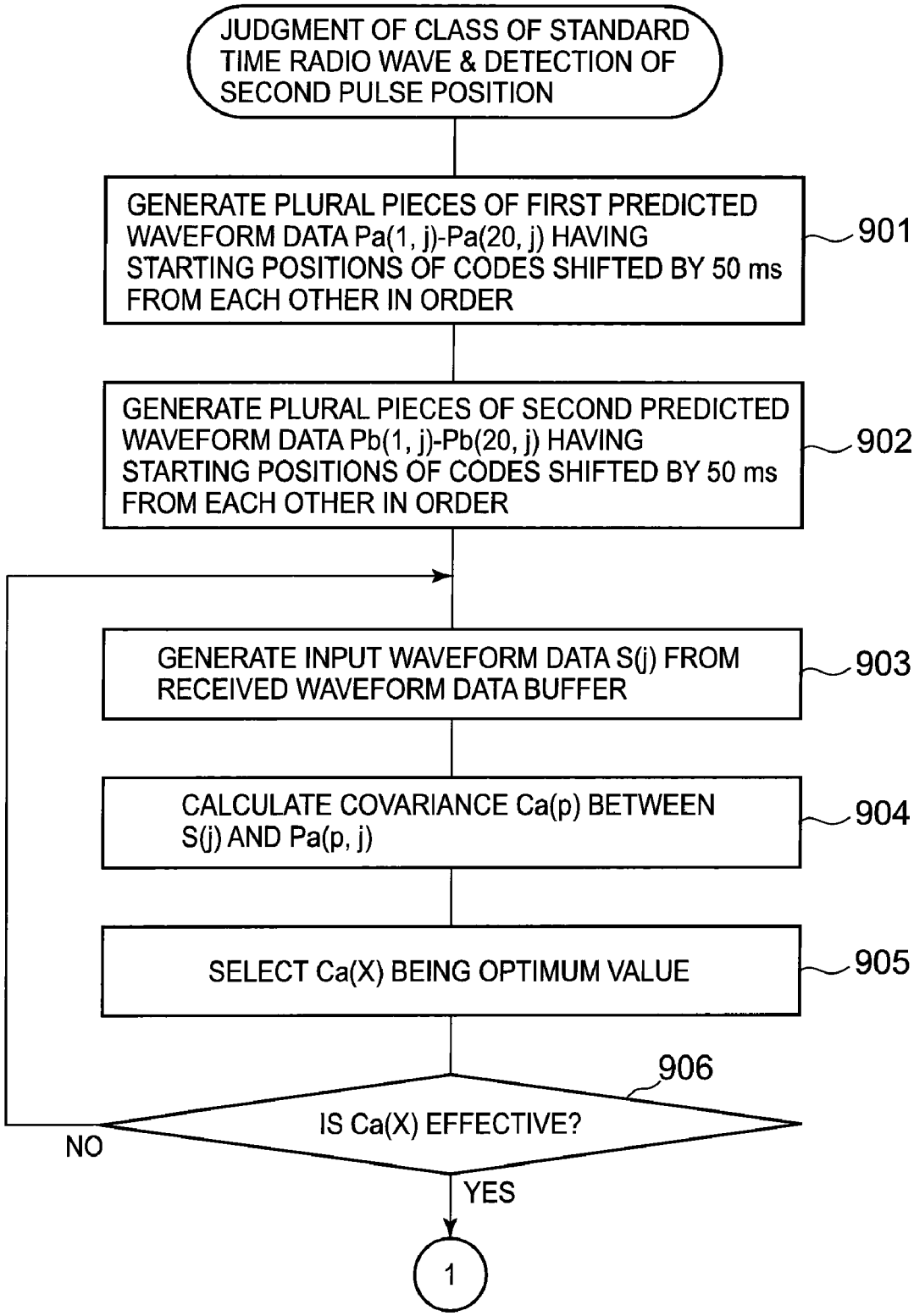
FIG. 9 is a flow chart more minutely showing examples of judgment processing of a class of a standard time radio wave and detecting processing of a second pulse position at Step 401 of FIG. 4.
Figure 10:
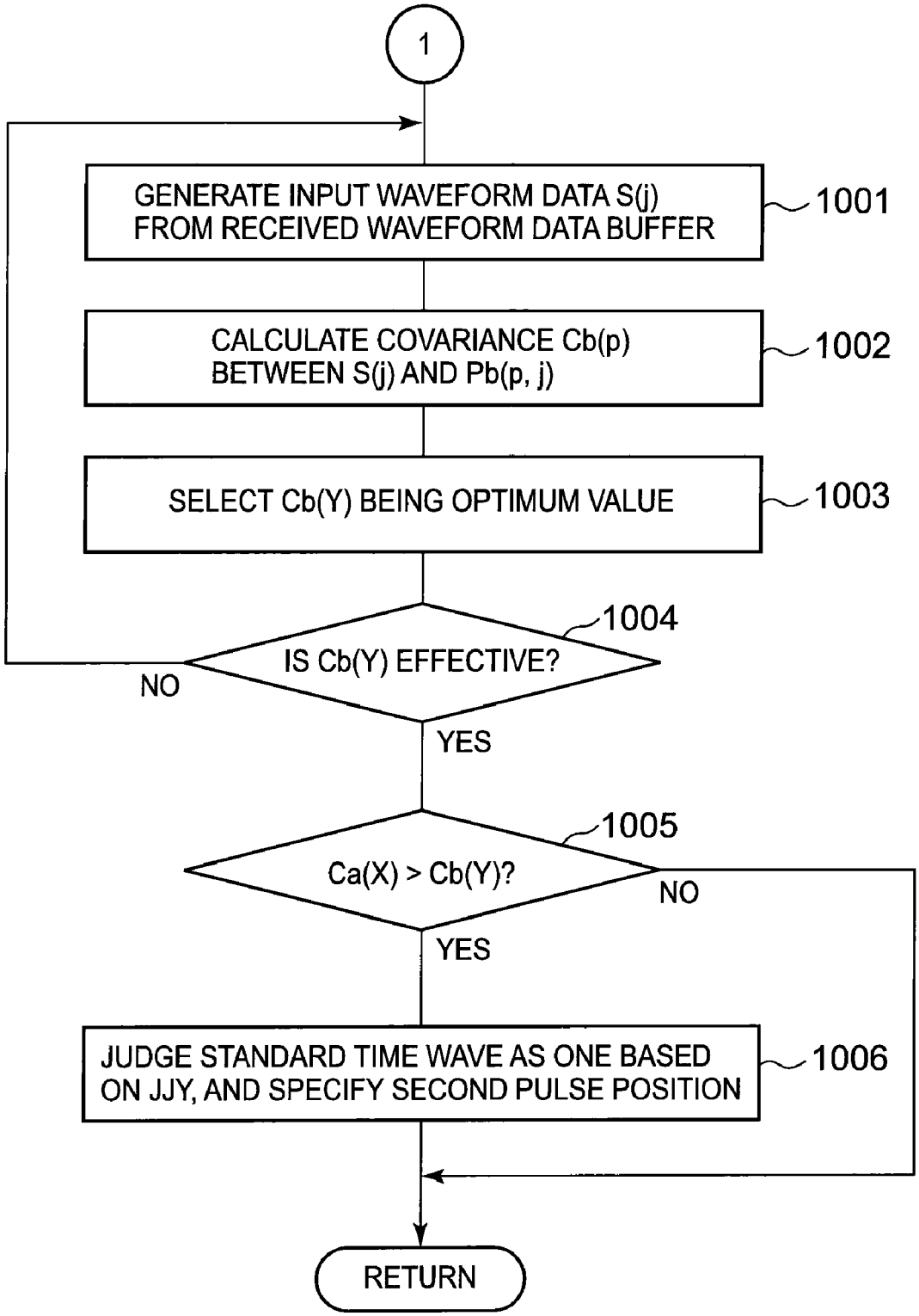
FIG. 10 is a flow chart more minutely showing examples of judgment processing of a class of a standard time radio wave and detecting processing of a second pulse position at Step 401 of FIG. 4.
Figure 11:
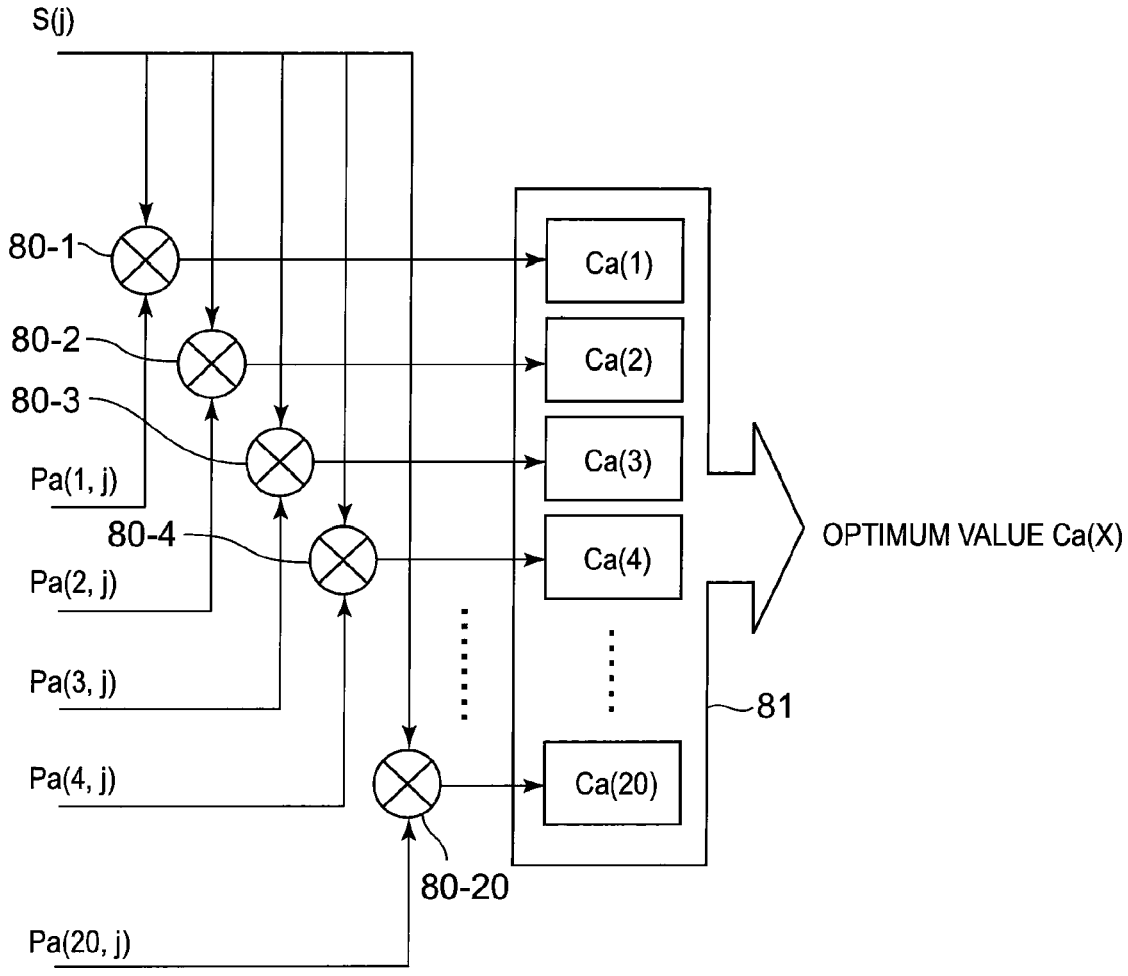
FIG. 11 is a diagram schematically showing judgment of a class of a standard time radio wave and detection of a second pulse position according to the present embodiment.
Figure 12:
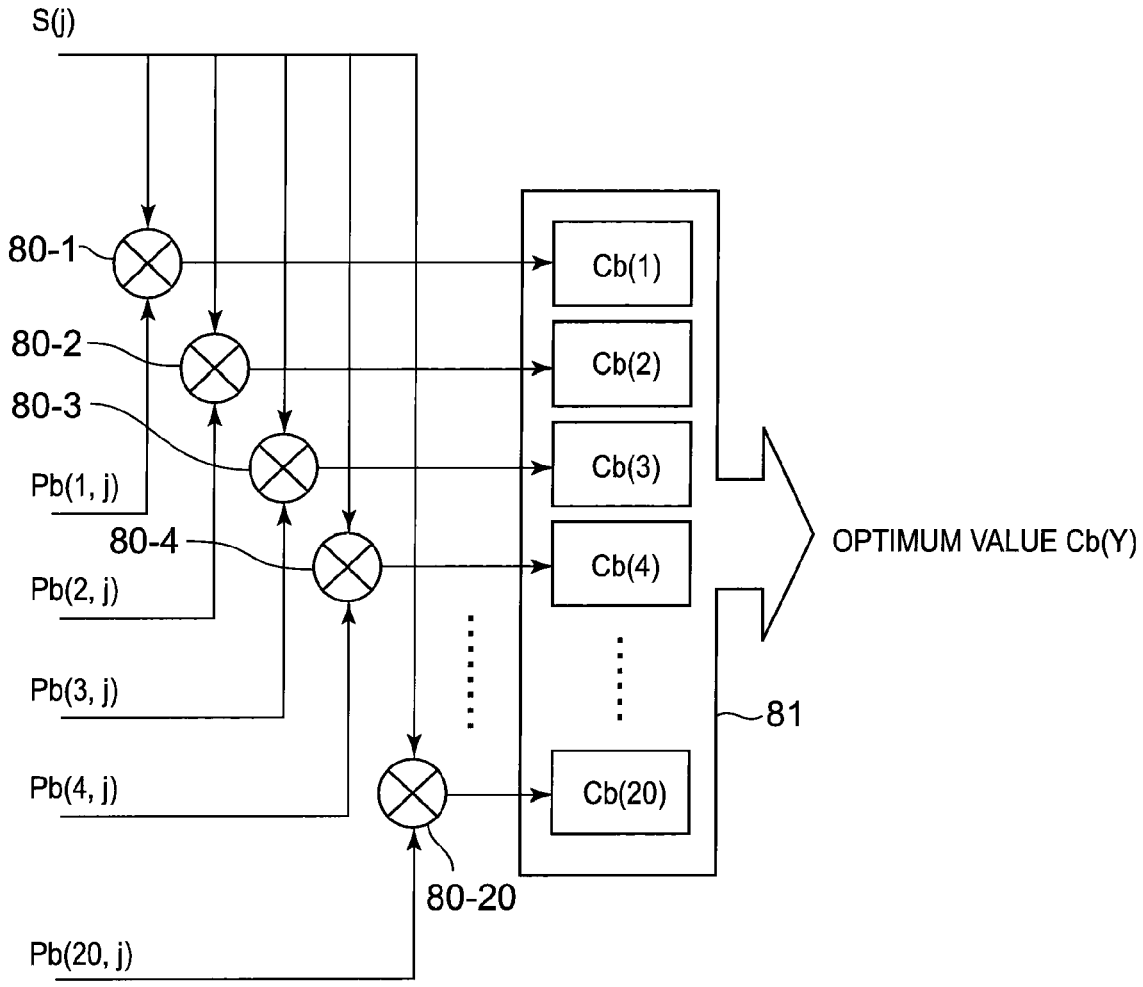
FIG. 12 is a diagram schematically showing judgment of a class of a standard time radio wave and detection of a second pulse position according to the present embodiment.

FIGS. 9 and 10 are flow charts more minutely showing the example of the judgment processing of the class of a standard time radio wave and the detecting processing of the second pulse position at Step 401 of FIG. 4. Moreover, FIGS. 11 and 12 are diagrams schematically showing the judgment of the class of a standard time radio wave and the detection of a second pulse position according to the present embodiment.

As shown in FIG. 9, the predicted waveform data generating section 23 generates a plurality of pieces of first predicted waveform data Pa(1, j)-Pa(20, j) having the starting positions of the code "0" by JJY shifted from each other by 50 ms (one sample) in order (Step 901), and generates a plurality of pieces of second predicted waveform data Pb(1, j)-Pb(20, j) having the starting positions of the code "0" by WWVB shifted from each other by 50 ms (one sample) in order (Step 902). The generated first predicted waveform data Pa(1, j)-Pa(20, j) and the second predicted waveform data Pb(1, j)-Pb(20, j) are temporarily stored in, for example, a buffer (not shown) in the predicted waveform data generating section 23.

Next, the waveform slicing section 24 slices a piece of data having a unit time length (one second) from the received waveform data buffer 22 in conformity with an instruction of the CPU 11, and generates input waveform data S(j) (Step 903). Incidentally, in order to speed up the processing thereof or to reduce the size of the received waveform data buffer 22, the waveform slicing section 24 may sequentially extract 20 pieces of sample data in the order of S(1), S(2), . . . , in the state in which not all of the data having one unit time length is stored in the received waveform data buffer 22.

After that, the correlation value calculating section 25 calculates correlation values (covariance values) Ca(p) (p=1-20) between the first predicted waveform data Pa(p, j) and the input waveform data S(j) in conformity with an instruction of the CPU 11 (Step 904). In the present embodiment, the correlation value calculating section 25 calculates the covariance values Ca(p) in conformity with the following formula by the use of the input waveform data S(j), the mean value Sm thereof, the first predicted waveform data Pa(p, j), and the mean value Pam. In FIG. 11, each of the reference numerals 80-1 to 80-20 denotes a covariance calculating section.

$$Ca(p)=(1/N)\times\Sigma((S(j)-Sm)\times(Pa(p,j)-Pam))$$

$$Sm=(1/N)\times\Sigma(S(j)),Pam=(1/N)\times\Sigma(Pa(p,j))$$

Incidentally, Σ concerns j=1−N. Incidentally, as described above, if the waveform slicing section 24 sequentially extracts sample data in the order of Sn(1), Sn(2), . . . , then not all the Sn(j) (j=1-N) is obtained at the beginning of the processing at Step 703. Consequently, the mean value Sm=(1/N)×Σ(Sn(j)) cannot be obtained at the stage of the beginning of the processing at Step 904.

However, the aforesaid Ca(p) is transformed to:

$$Ca(p)=(1/N)\Sigma(S(j)\times Pa(p,j))-Sm\times Pam.$$

Accordingly, the correlation value calculating section 25 has only to repeat the operation of S(j)×Pa(p, j) and the accumulation of the multiplication result to the addition result every obtainment of the sample data S(j) by the waveform slicing section 24, and then has only to calculate the mean value Sm to subtract Sm×Pam from the accumulation result at the time of obtaining the last sample data S(N).

When all of the correlation values (covariance values) Ca(1)-Ca(20) have been obtained, the correlation value comparing section 26 compares the obtained correlation values Ca(1)-Ca(20) to find the optimum value (the maximum value in this case) Ca(X) (Step 905; seen reference numeral 81 in FIG. 11). The CPU 11 receives the optimum value Ca(X), and judges whether the optimum value is effective or not (Step 906).

Although the optimum value Ca(X) indicating the maximum value is the predicted waveform having the highest correlation among the obtained covariance values Ca(p), the maximum value may also appear owing to an accidental primary factor caused by noise among the covariance values Ca(p) obtained from samples of insufficient population parameters. For the purpose of removing such a case, for example, any false detection is avoided by, for example, setting the following criteria for judgment at Step 906.

(1) The number of the pieces of input waveform data S(j) used for the covariance calculation shall be equal to or more than a predetermined number.

(2) The value of x indicating the optimum value Ca(X) shall appear a plurality of times. The plurality of values of x's shall be equal to one another, and the occurrence frequency of the values of x's is larger than those of the other values (x shall be the mode).

(3) The values of the x's shall be equal to one another predetermined times or more continuously (the continuity of the mode).

Incidentally, the set of the processing at Steps 903-905 of FIG. 9 is led to be executed a plurality of times in the case of performing the judgments of (1)-(3) mentioned above.

(4) The variance of the covariance values Ca(p) shall be equal to or less than a rated value.

(5) The kurtosis, the skewness, which are statistics of the covariance values Ca(p), or an evaluation function equivalent to them, shall be calculated, and it shall be judged whether the result reaches the rated value or not.

As a matter of course, the judgment of the effectiveness is not limited to the method described above. For example, even if a value is a locally maximal value of the correlation values Ca(p), the value smaller than the mean value Sm may be judged not to be significant with the help of the mean value Sm and the standard deviation value of the correlation values Ca(p), and a significant level (for example, 5%) common in statistics may be also used.

If the judgment result at Step 906 is no, then the processing returns to that at Step 903. On the other hand, if the judgment result at Step 906 is yes, that is, if the optimum value Ca(X) of the covariance values Ca(p) between the input waveform data S(j) and the first predicted waveform data Pa(p, j) is effective, then the waveform slicing section 24 slices data having one unit time length (one second) from the received waveform data buffer 22 in conformity with an instruction from the CPU 11 to generate the input waveform data S(j) (Step 1001).

The correlation value calculating section 25 calculates correlation values (covariance values) Cb(p) (p=1-20) between the respective pieces of the input waveform data S(j) and the respective piece of the second predicted waveform data Pb(p, j) in conformity with an instruction of the CPU 11 (Step 1002). The calculations of the covariance values Cb(p) are performed in conformity with the following formulae similarly to that at Step 904. Moreover, in FIG. 12, reference numerals 82-1 to 82-20 denote covariance calculating sections.

$$Cb(p)=(1/N)\times\Sigma((S(j)-Sm)\times(Pb(p,j)-Pbm))$$

$$Sm=(1/N)\times\Sigma(S(j)),Pbm=(1/N)\times\Sigma(Pb(p,j))$$

When all of the correlation values (covariance values) Cb(1)-Cb(20) have been obtained, the correlation value comparing section 26 compares the obtained correlation values Cb(1)-Cb(20) with one another to find the optimum value (the maximum value in this case) Cb(Y) (Step 1003. See the reference numeral 81 in FIG. 12). The CPU 11 receives the optimum value Cb(Y) to judge whether the optimum value Cb(Y) is effective or not (Step 1004). The judgment of the effectiveness at Step 1004 is similarly performed to that at Step 906.

If the judgment result at Step 1004 is no, then the processing returns to that at Step 1001. On the other hand, if the judgment result at Step 1004 is yes, that is, if the optimum value Cb(Y) of the covariance values Cb(p) between the input waveform data S(j) and the second predicted waveform data Pb(p, j) is effective, then the correlation value comparing section 26 compares the optimum value Ca(X) pertaining to the first predicted waveform data Pa(p, j) and the optimum value Cb(Y) pertaining to the second predicted waveform data Pb(p, j) to judge whether the optimum value Ca(X) is larger than the optimum value Cb(Y) or not (Step 1005). If the judgment result at Step 1005 is yes, then the CPU 11 judges that the received standard time radio wave is the one based on JJY, and that the starting position of the code "0" of the first predicted waveform data Pa(p, j) indicated by the optimum value Ca(X), that is, the rising position from the low level to the high level, is the second pulse position (Step 1006). The CPU 11 stores the information of the second pulse position into the RAM 15. The second pulse position is used in the processing of detecting a minute starting position, which will be described in the following, and the like.

In the example shown in FIGS. 9 and 10, it is judged whether a standard time radio wave is based on JJY or not at Step 1005, and the standard time radio waves (based on WWVB and MSF) other than that based on JJY are not compared. But, as a matter of course, it may be compared whether a standard time radio wave is based on WWVB or MSF.

Figure 13:
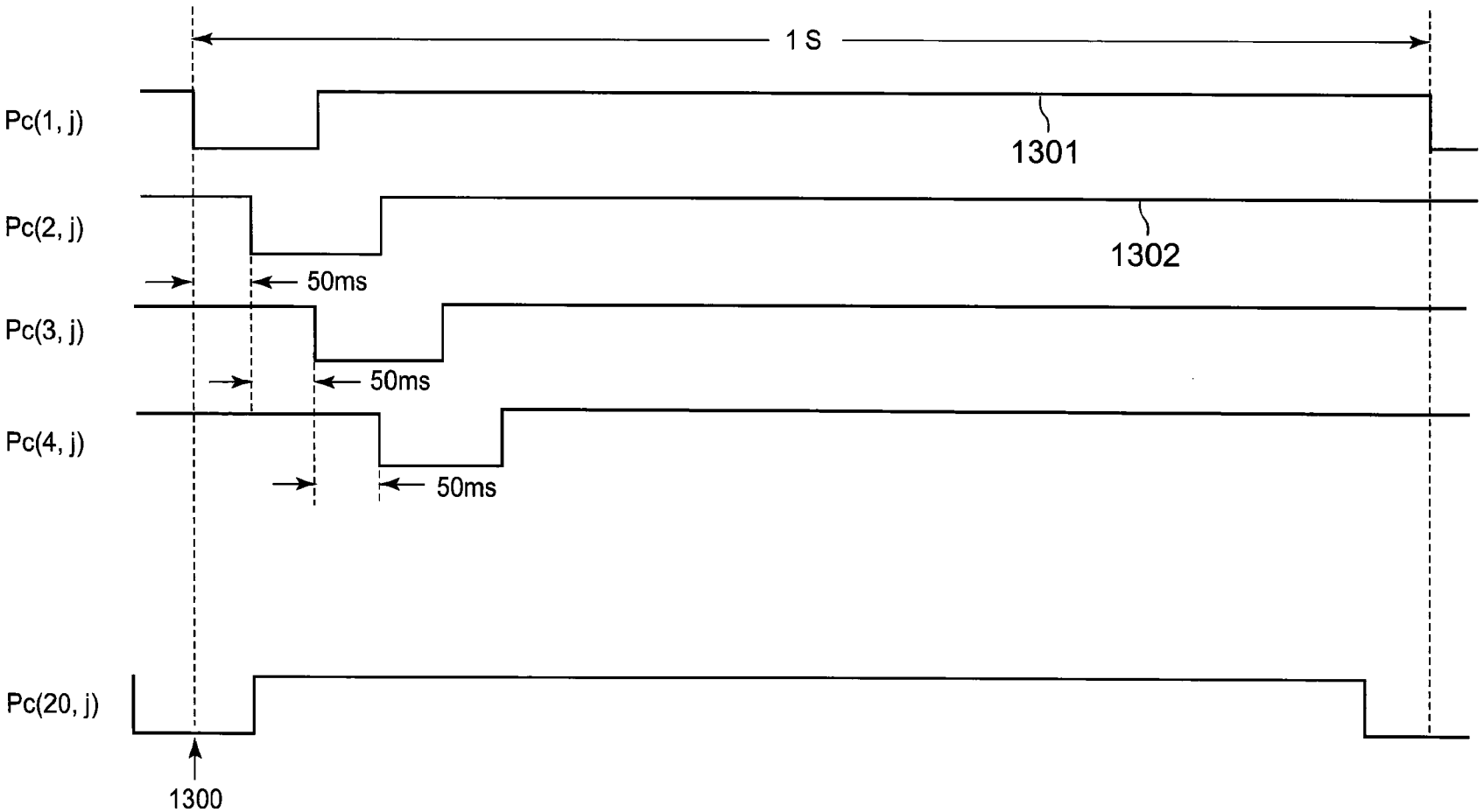
FIG. 13 is a diagram showing an example of a third predicted waveform data.
Figure 14:
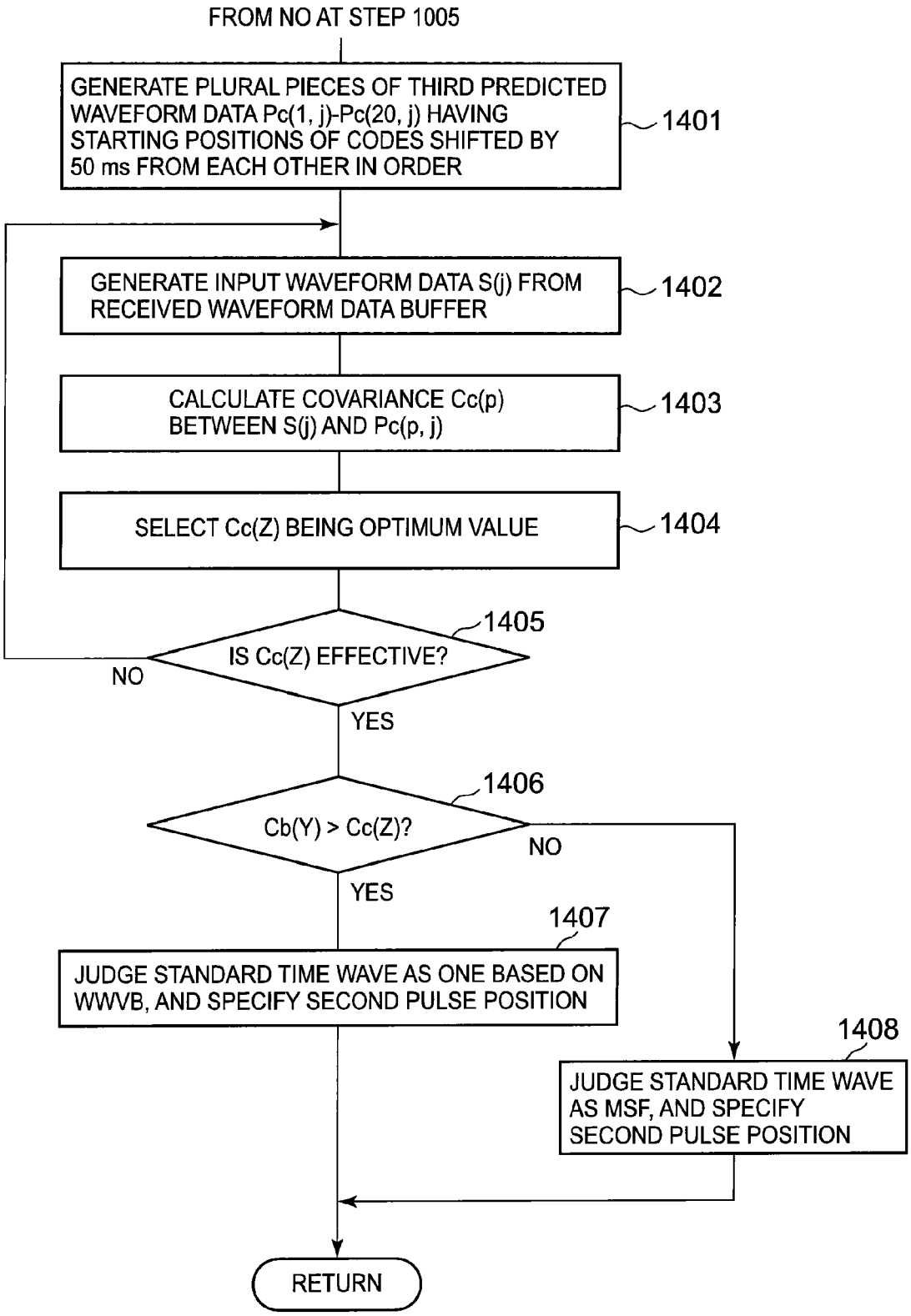
FIG. 14 is a flow chart showing an example of processing executable successively from the processing in FIGS. 9 and 10.

FIG. 13 shows an example of a third predicted waveform data, and FIG. 14 is a flow chart showing an example of processing executable successively from the processing in FIGS. 9 and 10. As shown in FIG. 13, each of 20 pieces of the third predicted waveform data Pc(1, j)-Pc(20, j) has a value of the data of a code "A=0, B=0" having a unit time length based on MSF, the starting position of which code is shifted from each other by 50 ms in order. For example, in initial third predicted waveform data Pc(1, j) (see reference numeral 1301), the starting position (see reference numeral 1300) of data and the starting position of the code agree with each other. On the other hand, in the next third predicted waveform data Pc(2, j) (see reference numeral 1302), the starting position of the code delays from the starting position 1300 of the data by 50 ms.

As shown in FIG. 14, if the judgment result at Step 1005 is no, the predicted waveform data generating section 23 generates the plurality of pieces of third predicted waveform data Pc(1, j)-Pc(20, j) of the code "A=0, B=0" based on MSF, each of which data has a starting position shifted by 50 ms (one sample) from each other in order (Step 1401).

Next, the waveform slicing section 24 slices data having one unit time length (one second) from the received waveform data buffer 22 to generate the input waveform data S(j) in conformity with an instruction of the CPU 11 (Step 1402). After that, the correlation value calculating section 25 calculates correlation values (covariance values) Cc(p) (p=1-20) between the respective pieces of the input waveform data S(j) and the respective pieces of the third predicted waveform data Pc(p, j) in conformity with an instruction of the CPU 11 (Step 1403).

The calculations of the covariance values Cc(p) are performed in conformity with the following formulae similarly to those at Steps 904 and 1002.

$$Cc(p)=(1/N)\times\Sigma((S(j)-Sm)\times(Pc(p,j)-Pcm))$$

$$Sm=(1/N)\times\Sigma(S(j)),Pcm=(1/N)\times\Sigma(Pc(p,j))$$

When all of the correlation values (covariance values) Cc(1)-Cc(20) have been obtained, the correlation value comparing section 26 compares the correlation values Cc(1)-Cc(20) with one another to find the optimum value (the maximum value in this case) Cc(Z) (Step 1404). The CPU 11 receives the optimum value Cc(Z) to judge whether the optimum value is effective or not (Step 1405). The judgment of the effectiveness at Step 1405 is similar to those at Steps 906 and 1004.

If the judgment result at Step 1405 is no, then the processing returns to that at Step 1402. On the other hand, if the judgment result at Step 1405 is yes, that is, if the optimum value Cc(Z) of the covariance values Cc(p) between the input waveform data S(j) and the third predicted waveform data Pc(p, j) is effective, then the correlation value comparing section 26 compares the optimum value Cb(Y) pertaining to the second predicted waveform data Pb(p, j) and the optimum value Cc(Z) pertaining to the third predicted waveform data Pc(p, j) to judge whether the optimum value Cb(Y) is larger than the optimum value Cc(Z) or not (Step 1406). If the judgment result at Step 1406 is yes, then the CPU 11 judges that the received standard time radio wave is the one based on WWVB, and judges that the starting position of the code "0" in the second predicted waveform data Pb(p, j) indicated by the optimum value Cb(Y), that is, the position of the fall from the high level to the low level, is the second pulse position (Step 1407). The CPU 11 stores the information of the second pulse position into the RAM 15.

If the judgment result at Step 1406 is no, then the CPU 11 judges that the received standard time radio wave is the one based on MSF, and judges that the starting position of the code "A=0, B=0" in the third predicted waveform data Pc(p, j) indicated by the optimum value Cc(Z), that is, the position of the fall from the high level to the low level, is the second pulse position (Step 1408). The CPU 11 stores the information of the second pulse position into the RAM 15.

As described above, by adding the processing shown in FIG. 14 to the processing shown in FIGS. 9 and 10, it also becomes possible to judge whether a standard time radio wave is that of WWVB or MSF.

Next, the detection of a minute starting position will be minutely described. In the following, the case where the judgment result at Step 1005 is yes and the received standard time radio wave is the one based on JJY will be described. Incidentally, the detection of the minute starting position is also referred to as minute synchronization.

Figure 15:
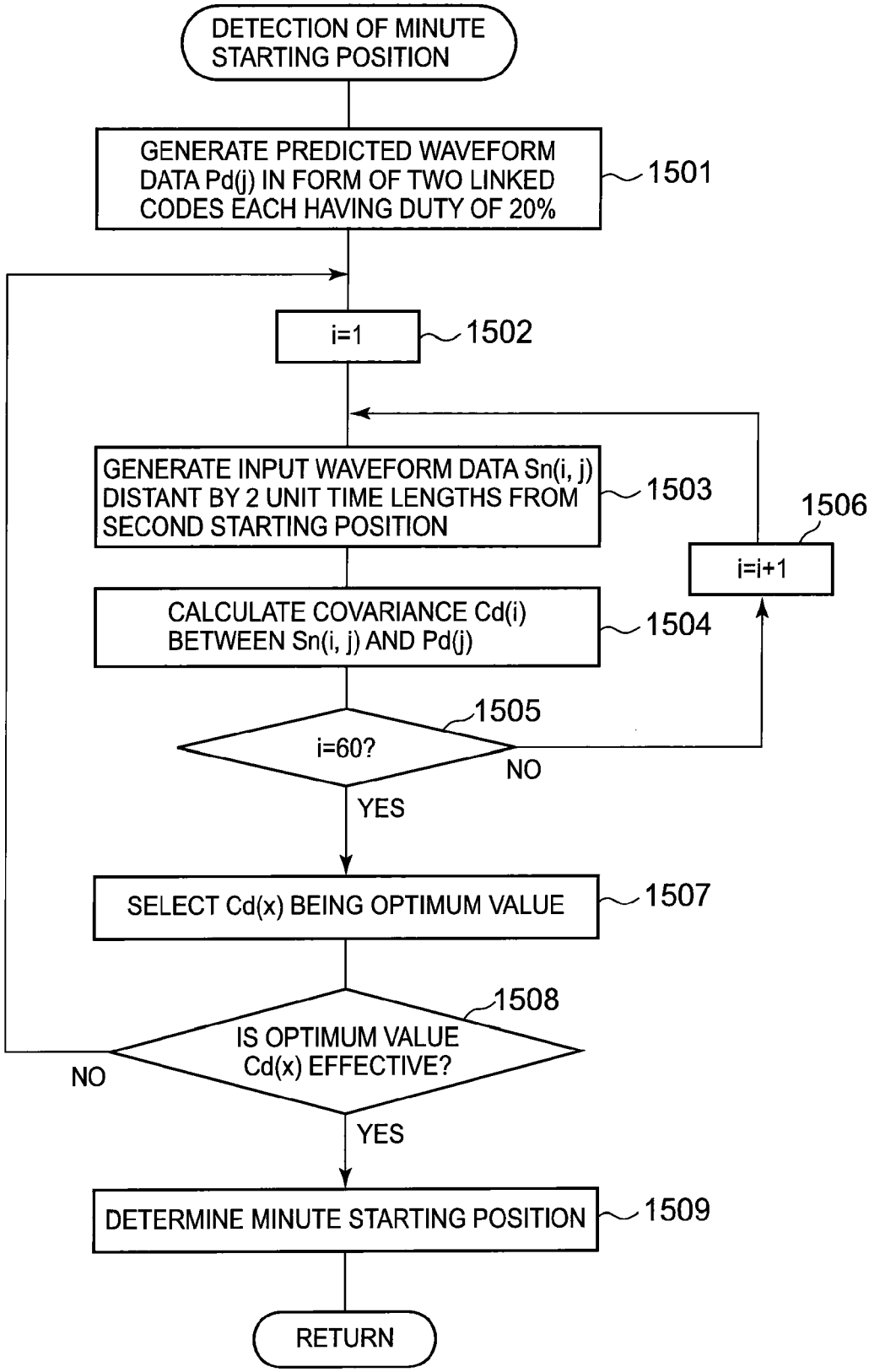
FIG. 15 is a flow chart showing detection of a minute starting position (minute synchronization) according to the present embodiment more minutely.

FIG. 15 is a flow chart showing the detection of the minute starting position (minute synchronization) according to the present embodiment more minutely. By the second synchronization, the second pulse position (the starting position of a second) has been already settled. Moreover, as shown in FIG. 6, in JJY, the codes "P" (the codes each having a duty ratio of 20%) continuously occur before and after the minute starting position (at 59 seconds and at 0 second). Accordingly, in the minute synchronization of JJY, predicted waveform data having two unit time lengths in the form in which the codes "P" continuously occur is generated. Moreover, 60 pieces of input waveform data, each of which is started from a second pulse position (second starting position) and has two unit time lengths (two seconds), are generated. It is possible to obtain 60 correlation values (covariance values) C(1)-C(60) by calculating the correlation values C(1)-C(60) between each piece of the predicted waveform data and each of the 60 pieces of input waveform data.

Figure 16:
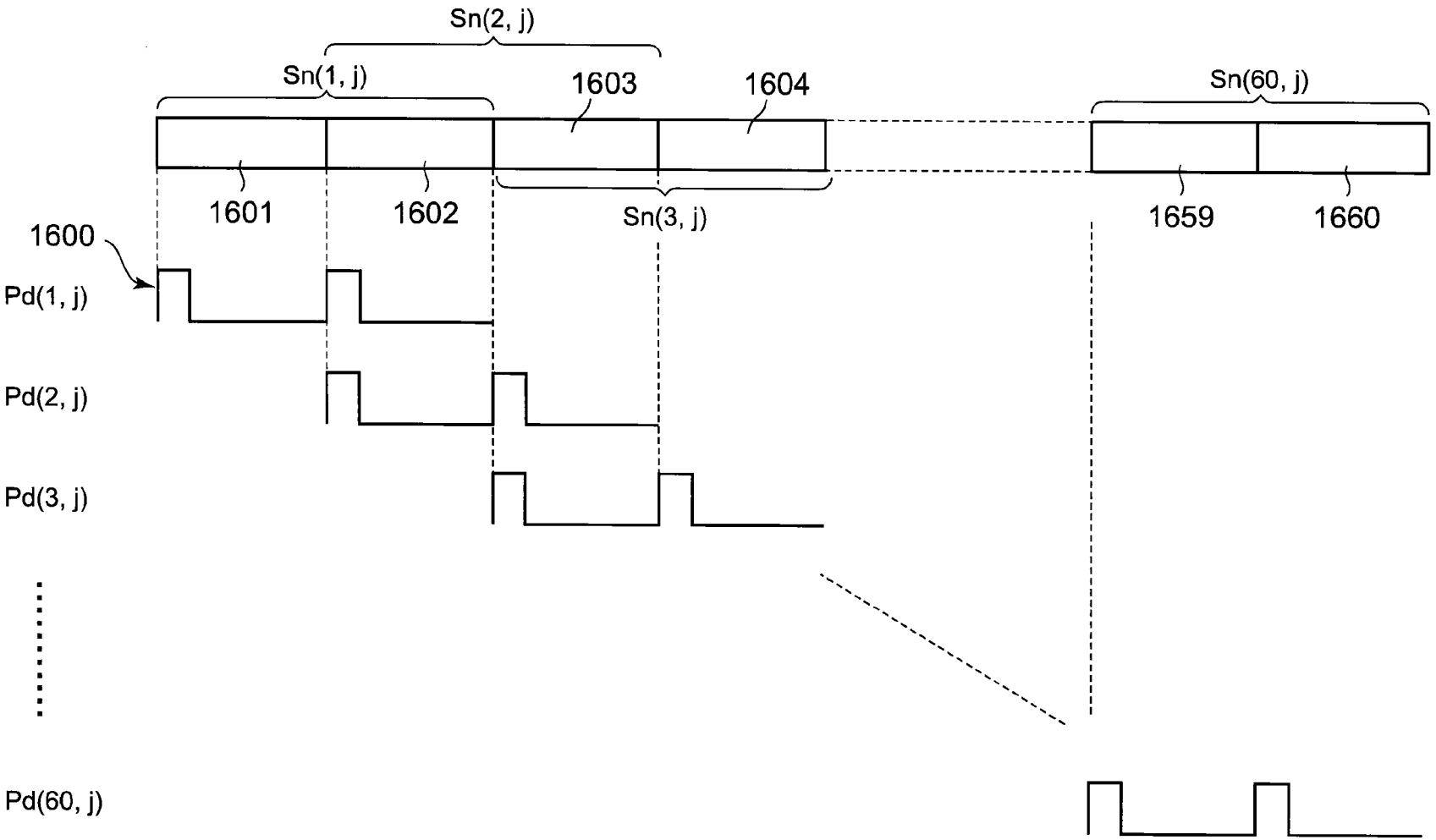
FIG. 16 is a diagram schematically showing input waveform data and predicted waveform data in detecting processing of a minute starting position according to the present embodiment.

As shown in FIG. 15, the predicted waveform data generating section 23 generates predicted waveform data Pd(j) in the form of linking two codes "P," which data Pd(j)) has two unit time lengths, in conformity with an instruction from the CPU 11 (Step 1501). As shown in FIG. 16, the predicted waveform data Pd(j) (see reference numeral 1600) is the data composed of two liked waveforms, each having a unit time length (one second), in which the predicted waveform data Pd(j) takes the high level during initial 200 ms and the low level during the remaining 800 ms.

Next, a parameter i for specifying a second starting position is initialized, and the waveform slicing section 24 obtains input waveform data Sn(i, j) having two unit time lengths (two seconds) from a second starting position out of the received waveform data buffer 22 in conformity with an instruction of the CPU 11 (Step 1503). The correlation value calculating section 25 calculates correlation values (covariance values) Cd(i) between the input waveform data Sn(i, j) and the predicted waveform data Pd(j) (Step 1504). Because the calculations of the covariance values Cd(i) are similar to those in the second synchronization processing, the description thereof is omitted.

The CPU 11 judges whether the parameter i is 60 or not (Step 1505). If the judgment result at Step 1505 is no, then the CPU 11 increments the parameter i (Step 1506). At successive Step 1503, the waveform slicing section 24 obtains the input waveform data Sn(i, j) having two unit time lengths (two seconds) at the next second starting position (that is, a time position behind the second starting position of the preceding input waveform data Sn(i, j) by 20 samples) in conformity with an instruction of the CPU 11. Successively, the covariance values Cd(i) between the newly obtained input waveform data Sn(i, j) and the predicted waveform data Pd(j) are calculated.

FIG. 16 is a diagram schematically showing the input waveform data Sn(i, j) and the predicted waveform data Pd(j) in the detecting processing of a minute starting position according to the present embodiment. As shown in FIG. 16, the input waveform data Sn(1, j) is composed of two pieces of data 1601 and 1602 having two unit time lengths from a certain second starting position. The next input waveform data Sn(2, j) is composed of two pieces of data 1602 and 1603 having two unit time lengths from the next second starting position. In this manner, the input waveform data Sn(n−1, j) and the input waveform data Sn(n, j) are the data having the second starting positions shifted from each other by the unit time length (one second). The rearmost input waveform data Sn(60, j) is composed of data 1659 and 1660 having two unit time lengths, which data 1659 and 1660 are shifted from the input waveform data Sn(1, j) at the starting position by 59 seconds.

A covariance value Cd(i) between each of the input waveform data Sn(1, j), Sn(2, j), Sn(3, j), . . . , Sn(60, j) and each of the predicted waveform data Pd(1, j), Pd(2, j), Pd(3, j), . . . , Pd(60, j) is calculated. Although the predicted waveform data Pd(1, j), Pd(2, j), Pd(3, j), . . . , Pd(60, j), to which the covariance values Cd(i) to the input waveform data Sn(1, j), Sn(2, j), Sn(3, j), . . . , Sn(60, j) are calculated, are denoted by Pd(1, j), Pd(2, j), Pd(3, j), . . . , Pd(60, j) in FIG. 16 for the sake of diagrammatic representation, actually these are the same value Pd(j).

When all of the correlation values (covariance values) Cd(1)-Cd(60) have been obtained, the correlation value comparing section 26 compares the correlation values Cd(1)-Cd(60) with one another to find the optimum value (the maximum value in this case) Cd(X) (Step 1507). The CPU 11 receives the optimum value Cd(X) to judge whether the optimum value Cd(X) is effective or not (Step 1508). Also the judgment of whether to be effective or not is similar to that of the second synchronization processing (Step 906 in FIG. 9). If the judgment result at Step 1508 is no, then the processing returns to Step 1502, and the waveform slicing section 24 obtains input waveform data Sn(i, j) stored in the received waveform data buffer 22, which input waveform data Sn(i, j) is different from the data used in the previous processing, in conformity with an instruction of the CPU 11.

If the judgment result at Step 1508 is yes, then the CPU 11 judges the starting position of a second code "P" in the input waveform data Sn(i, j) indicated by the optimum value Cd(X), that is, the position of a rise from the second low level to the high level, to be the starting position of a minute (Step 1509). The CPU 11 stores the information of the starting position of the minute into the RAM 15.

After that, the CPU 11 takes in 60 codes in order from the starting position of the minute, and judges the values of the codes to decode the codes (at Step 403 in FIG. 4). That is, the present time can be obtained from the judged values of the codes. Then, the CPU 11 corrects the present time timed by the internal timer circuit 17 on the basis of the obtained present time, and makes the display section 13 display the obtained present time.

According to the present embodiment, the waveform slicing section 24 samples a signal including a time code, which signal has been output from the receiving circuit 16, in a predetermined sampling period from the received waveform data buffer 22. The waveform slicing section 24 further generates input waveform data having one or more unit time lengths on the basis of the data which indicates a value expressed by a plurality of bits with respect to each of the sampling points and has the unit time length corresponding to the time length corresponding to one code constituting a time code. Moreover, the predicted waveform data generating section 23 generates predicted waveform data (first predicted waveform data and second predicted waveform data), each of the sampling points of which has a value expressed by a plurality of bits. The predicted waveform data has a time length same as that of the input waveform data, and has one or more unit time lengths representing each of the classes of standard time radio waves. The correlation value calculating section 25 calculates the correlation value with each of the predicted waveform data of each class, and the correlation value comparing section 26 calculates the optimum value of the correlation values of each class. The CPU 11 judges the classes of the standard time radio waves on the basis of the optimum value of each of the classes. The correlation values between the input waveform data and the predicted waveform data are calculated, and the optimum values of the correlation values of the respective classes are compared to one another. Thus, the class of a standard time radio wave is judged. Thereby, it becomes possible to judge the class of a standard time radio wave accurately at a high speed without depending on any forms of the input waveform data even if electric field strength is weak or if the signal contains much noise.

Moreover, according to the present embodiment, the CPU 11 judges the time position corresponding to the starting position of the code constituting the time code of the predicted waveform data to be the starting position of a second on the basis of the predetermined waveform data indicating the optimum value to the judged class. That is, in the present embodiment, it also becomes possible to perform second synchronization (the judgment of the starting position of a second) together with the judgment of the class of the standard time radio wave.

For example, in the present embodiment, the predicted waveform data generating section 23 generates the first predicted waveform data representing JJY in Japan and the second predicted waveform data representing another class (for example, WWVB), and compares the first optimum value of the correlation values between the first predicted waveform data and the input waveform data with the second optimum value of the correlation values between the second predicted waveform data and the input waveform data. If the first optimum value is the value showing goodness much more than that of the second optimum value, the class of the standard time radio wave can be judged to be JJY.

More minutely, in the present embodiment, the predicted waveform data generating section 23 generates the data having a unit time length, which data corresponds to the code "0" by JJY, as the first predicted waveform data, and the data having the unit time length, which data corresponds to the code "0" by WWVB, as the second predicted waveform data. This enables the calculation of the correlation values and the judgment of the class of a standard time radio wave using predicted waveform data having a simple data configuration.

Moreover, in the present embodiment, the predicted waveform data generating section 23 generates the second predicted waveform data representing WWVB and the third predicted waveform data representing MSF, and the correlation value comparing section 26 compares the second optimum value of the correlation values between the second predicted waveform data and the input waveform data with the third optimum value of the correlation values between the third predicted waveform data and the input waveform data. This also enables the judgment of whether a standard time radio wave is based on WWVB or MSF.

More minutely, the predicted waveform data generating section 23 generates the data having a unit time length, which data corresponds to the code "A=0, B=0" by MSF, as the third predicted waveform data. Consequently, it becomes possible to calculate the correlation values and to judge the class of a standard time radio wave using predicted waveform data having a simple data configuration.

For example, if the CPU 11 judges the class of a standard time radio wave to be JJY, then the CPU 11 judges the position of a rise from the low level to the high level in the first predicted waveform data showing the optimum value as the starting position of a second. Moreover, if the CPU 11 judges the class of a standard time radio wave to be WWVB, then the CPU 11 judges the position of a fall from the high level to the low level in the second predicted waveform data showing the optimum value to be the starting position of a second. If the CPU 11 judges the class of a standard time radio wave to be MSF, then the CPU 11 judges the position of a fall from the high level to the low level in the third predicted waveform data showing the optimum value to be the starting position of a second. This enables the judgment of the starting position of a second independently on the forms of the input waveform data without being subjected to any complicated processing and without being influenced by noise and the like.

Next, a second embodiment will be described. In the first embodiment, the effectiveness of the optimum values of covariances (for example, Ca(X) and Cb(Y)) is judged. When the optimum values are effective, the optimum values are compared with each other to judge the class of a standard time radio wave, and the starting position of a second in the judged standard time radio wave is specified. The present invention is not limited to this configuration, and the class of a standard time radio wave may be judged without judging any effectiveness of the optimum values.

Figure 17:
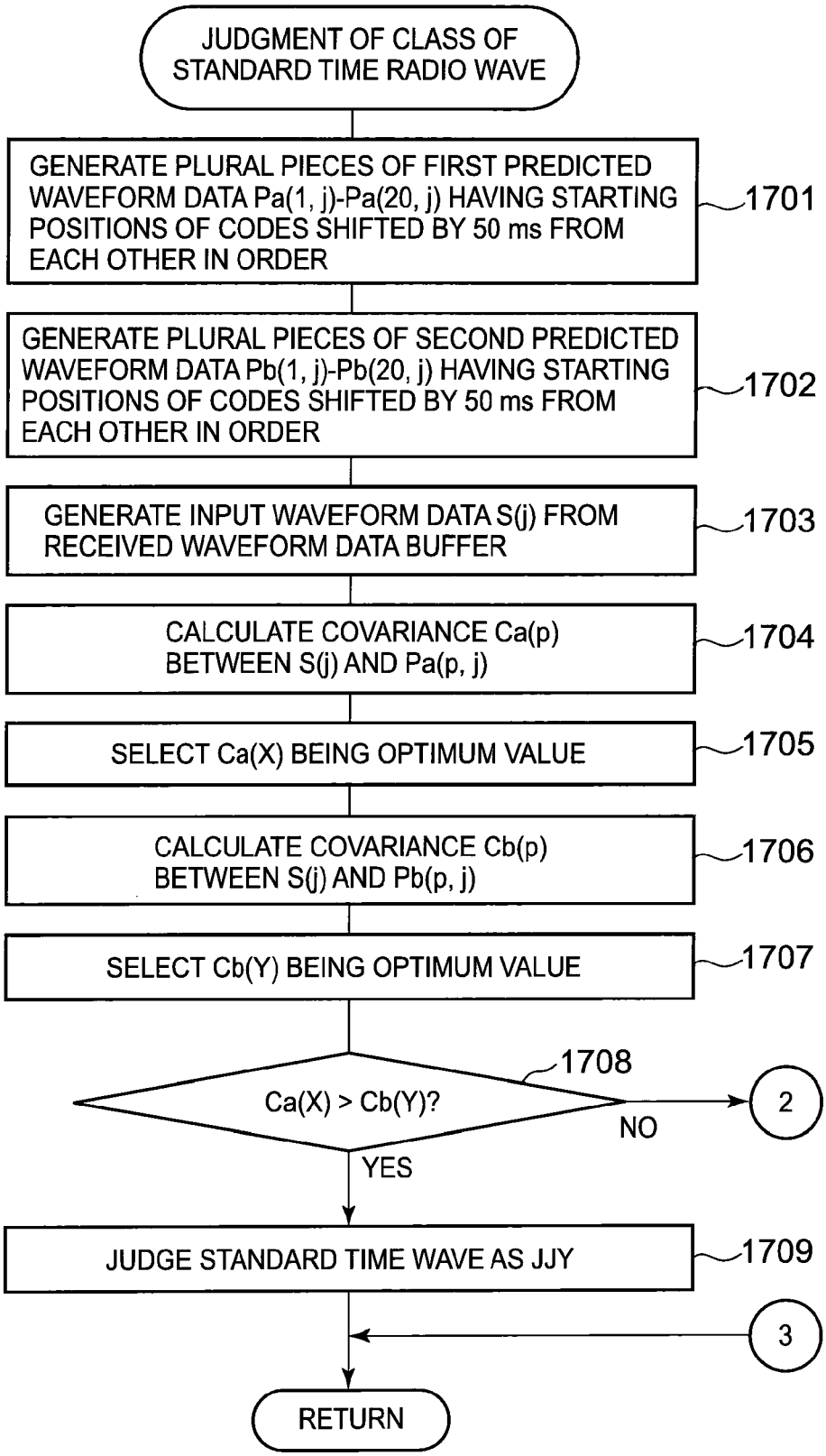
FIG. 17 is a flow chart showing an example of judging processing of a standard time radio wave according to the second embodiment.
Figure 18:
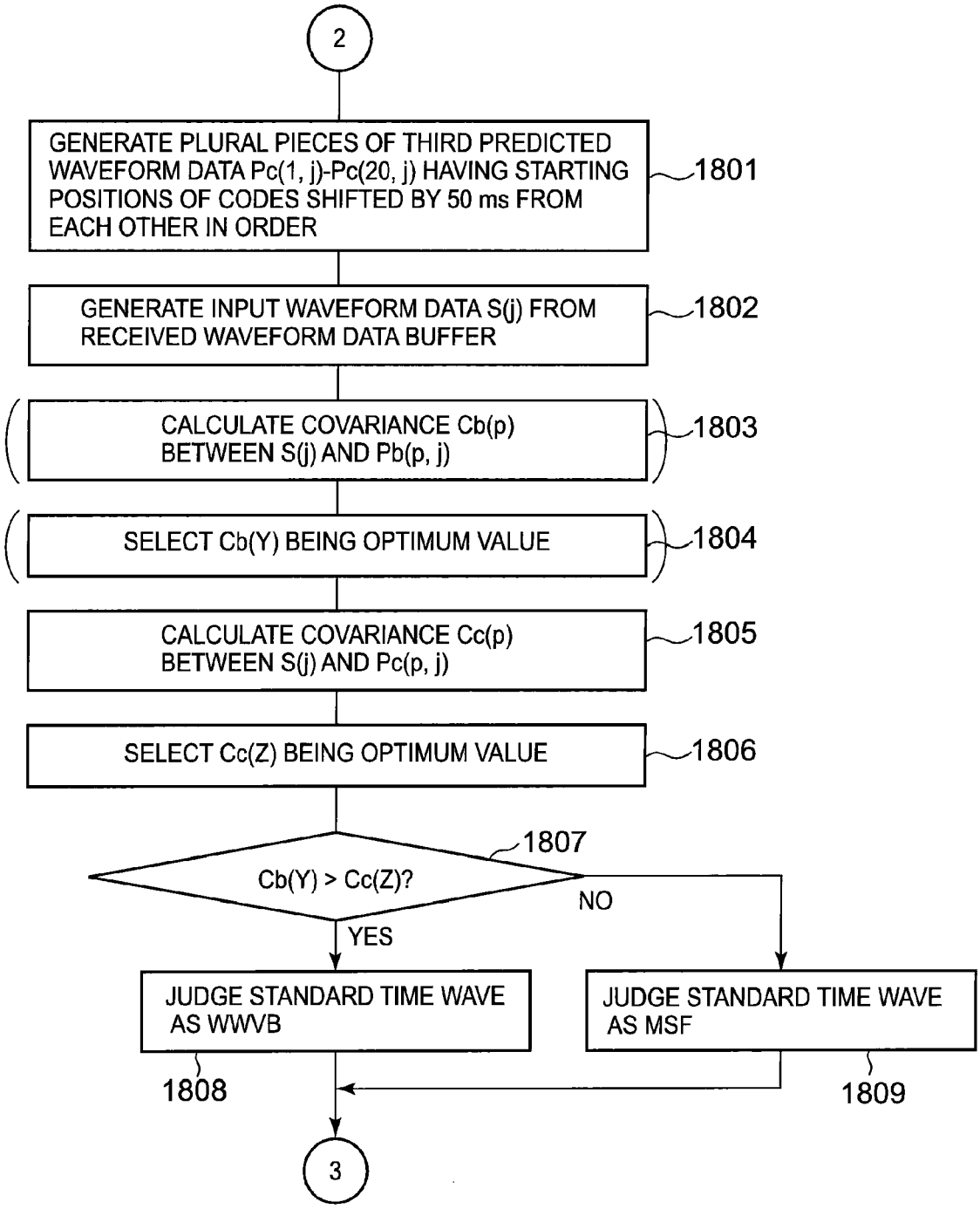
FIG. 18 is a flow chart showing an example of judging processing of a standard time radio wave according to the second embodiment.

FIGS. 17 and 18 are flow charts showing an example of judging processing of a standard time radio wave according to the second embodiment. In FIG. 17, the processing at Steps 1701-1703 is similar to that at Steps 901-903 in FIG. 9.

After the processing at Step 1703, the correlation value calculating section 25 calculates correlation values (covariance values) Ca(p)(p=1-20) between the input waveform data S(j) and the first predicted waveform data Pa(p, j) in conformity with an instruction of the CPU 11 (Step 1704). The calculations of the covariance values Ca(p) are similar to those at Step 904. When all of the correlation values (covariance values) Ca(1)-Ca(20) have been obtained, the correlation value comparing section 26 compares the correlation values Ca(1)-Ca(20) to one another to find the optimum value (the maximum value in this case) Ca(X) (Step 1705).

Moreover, the correlation value calculating section 25 calculates the correlation values (covariance values) Cb(p) (p=1-20) between the input waveform data S(j) and the second predicted waveform data Pb(p, j) in conformity with an instruction of the CPU 11 (Step 1706). When all of the correlation values (covariance values) Cb(1)-Cb(20) have been obtained, the correlation value comparing section 26 compares the correlation values Cb(1)-Cb(20) with one another to find the optimum value (the maximum value in this case) Cb(Y) (Step 1707).

The correlation value comparing section 26 compares the optimum value Ca(X) pertaining to the first predicted waveform data Pa(p, j) and the optimum value Cb(Y) pertaining to the second predicted waveform data Pb(p, j) to judge whether the optimum value Ca(X) is larger than the optimum value Cb(Y) or not (Step 1708). If the judgment result at Step 1708 is yes, then the CPU 11 judges that the received standard time radio wave is the one based on JJY (Step 1709).

In the second embodiment, if the judgment result at Step 1708 is no, then the CPU 11 judges whether the received standard time radio wave is the one based on WWVB or the one based on MSF. As shown in FIG. 18, the predicted waveform data generating section 23 generates a plurality of third predicted waveform data Pc(1, j)-Pc(20, j), in which the starting positions of the codes "A=0, B=0" by MSF are shifted from each other by 50 ms (one sample) in order (Step 1801). Moreover, the waveform slicing section 24 slices the data having one unit time length (one second) from the received waveform data buffer 22 to generate the input waveform data S(j) (Step 1802).

After that, the correlation value calculating section 25 calculates the correlation values (covariance values) Cb(p)(p=1-20) between the input waveform data S(j) and the second predicted waveform data Pb(p, j) in conformity with an instruction of the CPU 11 (Step 1803). After that, the correlation value comparing section 26 compares the correlation values Cb(1)-Cb(20) with one another to find the optimum value (the maximum value in this case) Cb(Y) (Step 1804). Incidentally, because the calculations of the covariance values Cb(p) and the selection of the optimum value Cb(Y) have been performed in Steps 1706 and 1707, respectively, the processing at Steps 1803 and 1804 may be omitted.

The correlation value calculating section 25 calculates the correlation values (covariance values) Cc(p) (p=1-20) between the input waveform data S(j) and the third predicted waveform data Pc(p, j) in conformity with an instruction of the CPU 11 (Step 1805). After that, the correlation value comparing section 26 compares the correlation values Cc(1)-Cc(20) with one another to find the optimum value (the maximum value in this case) Cc(Z) (Step 1806).

Next, the correlation value comparing section 26 compares the optimum value Cb(Y) pertaining to the second predicted waveform data Pb(p, j) and the optimum value Cc(Z) pertaining to the third predicted waveform data Pc(p, j) to judges whether the optimum value Cb(Y) is larger than the optimum value Cc(Z) or not (Step 1807). If the judgment result at Step 1807 is yes, then the CPU 11 judges that the received standard time radio wave is the one based on WWVB (Step 1808). On the other hand, if the judgment result at Step 1807 is no, then the CPU 11 judges that the received standard time radio wave is the one based on MSF (Step 1809).

Incidentally, in the second embodiment, the processing of second synchronization, that is, the processing of specifying the starting position of a second, may be performed after the judgment of the class of the standard time radio wave. In this case, the CPU 11 may calculates the covariance values between the input waveform data S(j) and the predicted waveform data of the judged class (for example, the first predicted waveform data Pa(1, j)-Pa(20, j) when the standard time radio wave is judged to be the one based on JJY), and may obtain the optimum value thereof to judge the starting position of the code indicated by an effective optimum value to be a second pulse position (the starting position of a second) when the optimum value is judged to be effective.

Alternatively, in each of Steps 1709, 1808, and 1809, the CPU 11 may judge the starting position of a predetermined code (the code "0" in the cases of JJY and WWVB, and the code "A=0, B=0" in the case of MSF) in the predicted waveform data indicated by the optimum value to be a second pulse position in addition to the judgment of the class of a standard time radio wave.

It is needless to say that the present invention is not limited to the embodiments described above, but that various modifications can be performed within the scope of the invention described in claims, and that the modifications are also included in the scope of the present invention.

For example, each of the embodiments described above generates a plurality of pieces of first predicted waveform data Pa(p, j), the starting positions of the codes "0" by JJY of which are shifted from each other by a predetermined time length (50 ms) in order, as the first predicted waveform data Pa(p, j) representing JJY. Moreover, each of the embodiments generates a plurality of pieces of second predicted waveform data Pb(p, j), the starting positions of the codes "0" by WWVB of which are shifted from each other by a predetermined time length (50 ms) in order, as the second predicted waveform data Pb(p, j) representing WWVB. Furthermore, each of the embodiments generates a plurality of pieces of third predicted waveform data Pc(p, j), the starting positions of the codes "A=0, B=0" by MSF of which are shifted from each other by a predetermined time length (50 ms) in order, as the third predicted waveform data Pc(p, j) representing MSF.

This is because the frequencies of appearances of the code "0," the code "0," and the code "A=0, B=0" are higher than the other codes in JJY, WWVB, and MSF, respectively, and because it is possible to obtain more suitable covariance values Ca(p), Cb(p), and Cc(p) by generating predicted waveform data Pa(p, j), Pb(p, j), and Pc(p, j), respectively, by the use of these codes "0," "0," and "A=0, B=0," respectively, to compare the generated predicted waveform data Pa(p, j), Pb(p, j), and Pc(p, j) with input waveform data S(j). However, the present invention is not limited to use these codes "0," "0," and "A=0, B=0," but the following predicted waveform data may be also generated.

For example, a time code over an actual predetermined period based on JJY may be sliced into a plurality of codes, each having a unit time length, and predicted waveform data indicating a mean value at each sampling point of the codes, each having the unit time length, may be generated. Then, a plurality of pieces of first predicted waveform data, the starting positions of which are shifted from each other by 50 ms (one sample) in order, may be generated. In this example, a certain specific time is set as a starting position time, and the values of corresponding sampling points of a plurality of codes for M seconds, for example, 60 seconds, are accumulated at each of codes Ck(j) (k=1-M, j=1-20), each having the unit time length (one second). Then, the mean value at each of the sampling points can be obtained by dividing the accumulation values of the sampling points by the total number M of the codes. That is, the obtained predicted waveform data S(j) takes the following values.

$$S(j)=\Sigma(Ck(j))/M$$

Incidentally, Σ in the above formula pertains to k (k=1-M). Moreover, j=1-20.

Also concerning WWVB and MSF, the predicted waveform data indicating a mean value at each of the sampling points of codes, each having a unit time length, may be similarly generated in regard to time codes over actual predetermined periods, and a plurality of pieces of second predicted waveform data and third predicted waveform data, the starting points of each of which are shifted from each other by 50 ms (one sample) in order, may be generated.

Moreover, in the judgment of the class of a standard time radio wave (and second synchronization possible to be simultaneously performed), input waveform data may be generated a plurality of times, and the correlation values (covariance values) between the pieces of generated input waveform data and a plurality of pieces of predicted waveform data may be calculated. Then, the correlation values of the related predicted waveform data (the same predicted waveform data) may be accumulated, and the optimum value may be found by finally referring to the accumulated correlation values. By the use of the accumulated correlation values, it becomes possible to reduce the influences of the nose included in input waveform data to the correlation values. Also in minute synchronization, input waveform data may be generated a plurality of times, and the correlation values (covariance values) between the pieces of input waveform data and a plurality of pieces of predicted waveform data may be calculated. Then, the correlation values may be accumulated with regard to related predicted waveform data (the same predicted waveform data), and the optimum value may be finally found by referring to the accumulated correlation values.

By using the accumulated correlation values in this manner, the influences of noise can be more appropriately removed, and the judgment of the class of a standard time radio wave can be performed more accurately.

Moreover, in the judgments of the standard time radio waves according to the embodiments described above, the input waveform data and the predicted waveform data, each having a unit time length, are generated. However, the data lengths are not limited to the unit time length, but the data having one or more unit time lengths, for example, two unit time lengths, may be generated. In this case, the waveform slicing section 24 generates the input waveform data having the two unit time lengths from the received waveform data buffer 22. Moreover, the predicted waveform data generating section 23 generates the first to third pieces of predicted waveform data, each predicted waveform data being in the form of two continuing unit time lengths. As a matter of course, the data lengths may be longer than the two unit time lengths.

Moreover, although the covariance values are used as the correlation values in the embodiments described above, the correlation values are not limited to these covariance values. For example, residuals, each of which is the total sum of the absolute values of differences, may be used as the correlation values. Alternatively, cross-correlation coefficients may be used in place of the covariances and the residuals.

What is claimed is:

1. A time information obtaining apparatus, comprising:

a receiving section for receiving a standard time radio wave;

an input waveform data generating section for sampling a signal including a time code output from the receiving section at a predetermined sampling period to obtain sampling points every one unit time length corresponding to one code constituting the time code, each of the sampling points being a value expressed by a plurality of bits, and generating input waveform data having one or more unit time lengths based on data having at least one of the unit time lengths each including the obtained sampling points;

a predicted waveform data generating section for generating a plurality of pieces of predicted waveform data, each sampling point of which is a value expressed by a plurality of bits, the predicted waveform data having a same time length as that of the input waveform data, the predicted waveform data being waveform data having one or more unit time lengths representing each of classes of standard time radio waves with respect to each class of the standard time radio wave, and starting positions of the waveform data being shifted from each other in order;

a correlation value calculating section for calculating correlation values between the input waveform data and the plurality of pieces of predicted waveform data of each of the classes;

a correlation value comparing section for comparing the correlation values calculated by the correlation value calculating section to one another to calculate an optimum value of the correlation values of each of the classes; and a judging section for judging the class of the standard time wave based on the optimum value of each of the classes, wherein the judging section judges a position corresponding to a starting position of the code constituting the time code in the predicted waveform data to be a second starting position based on the predicted waveform data indicating the optimum value with regard to the judged class.

2. The time information obtaining apparatus according to claim 1, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

3. The time information obtaining apparatus according to claim 1, wherein the predicted waveform data generating section generates a first predicted waveform data representing JJY of Japan and a second predicted waveform data representing another class, and the judging section compares a first optimum value of correlation values between the first predicted waveform data and the input waveform data with a second optimum value of correlation values between the second predicted waveform data and the input waveform data.

4. The time information obtaining apparatus according to claim 3, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

5. The time information obtaining apparatus according to claim 3, wherein the predicted waveform data generating section generates data having the unit time length corresponding to a code "0" of JJY in Japan as the first predicted waveform data and data having the unit time length corresponding to a code "0" of WWVB of the United States of America as the second predicted waveform data.

6. The time information obtaining apparatus according to claim 5, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

7. A radio wave timepiece, comprising:

the time information obtaining apparatus according to claim 5;

a decoding section for obtaining values of codes including a day, a time, and a minute constituting the time code in accordance with the values indicated by the codes calculated by the time information obtaining apparatus;

a present time calculating section for calculating present time based on the values of the codes obtained by the decoding section;

an internal timer section to time the present time by an internal clock;

a time correcting section for correcting the present time timed by the internal timer section based on the present time obtained by the present time calculating section; and a time display section for displaying any one of the present time timed by the internal timer section and the present time corrected by the time correcting section.

8. The time information obtaining apparatus according to claim 5, wherein when the judging section judges the class of the standard time radio wave to be JJY of Japan, the judging section judges a position of a rise from a low level to a high level of the first predicted waveform data indicating the optimum value to be the second starting position.

9. The time information obtaining apparatus according to claim 8, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

10. The time information obtaining apparatus according to claim 3, wherein the predicted waveform data generating section generates the second predicted waveform data representing WWVB of the United States of America and third predicted waveform data representing MSF of the United Kingdom, and the judging section compares the second optimum value of the correlation values between the second predicted waveform data and the input waveform data with a third optimum value of correlation values between the third predicted waveform data and the input waveform data.

11. The time information obtaining apparatus according to claim 10, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

12. The time information obtaining apparatus according to claim 10, wherein the predicted waveform data generating section generates data having the unit time length corresponding to a code "0" of JJY in Japan as the first predicted waveform data, data having the unit time length corresponding to a code "0" of WWVB of the United States of America as the second predicted waveform data, and data having a unit time length corresponding to a code "A=0, B=0" of MSF of the United Kingdom as the third predicted waveform data.

13. The time information obtaining apparatus according to claim 12, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

14. The time information obtaining apparatus according to claim 12, wherein:

when the judging section judges the class of the standard time radio wave to be WWVB of the United States of America, the judging section judges a position of a fall from a high level to a low level of the second predicted waveform data indicating the optimum value to be the second starting position; and when the judging section judges the class of the standard time radio wave to be MSF of the United Kingdom, the judging section judges a position of a fall from the high level to the low level of the third predicted waveform data indicating the optimum value to be the second starting position.

15. A radio wave timepiece, comprising:

the time information obtaining apparatus according to claim 14;

a decoding section for obtaining values of codes including a day, a time, and a minute constituting the time code in accordance with the values indicated by the codes calculated by the time information obtaining apparatus;

a present time calculating section for calculating present time based on the values of the codes obtained by the decoding section;

an internal timer section to time the present time by an internal clock;

a time correcting section for correcting the present time timed by the internal timer section based on the present time obtained by the present time calculating section; and a time display section for displaying any one of the present time timed by the internal timer section and the present time corrected by the time correcting section.

16. The time information obtaining apparatus according to claim 14, wherein:

the input waveform data generating section repeats generation of the input waveform data a plurality of times, and the correlation value calculating section repeats calculation of the correlation value a plurality of times; and the correlation value comparing section accumulates the correlation values calculated concerning same predicted waveform data with regard to the plurality of pieces of predicted waveform data, and calculates the optimum value of the accumulated correlation values.

* * * * *